US009649552B2

(12) United States Patent
Blank et al.

(10) Patent No.: US 9,649,552 B2
(45) Date of Patent: May 16, 2017

(54) SYSTEM AND METHOD FOR GENERATING AND USING SOLVABLE PUZZLE FORMS

(71) Applicant: TMGCL IP Holdings Limited, Surrey (GB)

(72) Inventors: Shohreh Blank, London (GB); Manoochehr Azmoodeh, Ipswich (GB); Nathan Frederick Alamo-Pritchard, Slough (GB)

(73) Assignee: TMGCL IP HOLDINGS LIMITED, Surrey (GB)

( * ) Notice: Subject to any disclaimer, the term of this patent is extended or adjusted under 35 U.S.C. 154(b) by 827 days.

(21) Appl. No.: 14/086,855

(22) Filed: Nov. 21, 2013

(65) Prior Publication Data

US 2015/0137449 A1 May 21, 2015

(51) Int. Cl.
*A63F 3/00* (2006.01)
*A63F 3/04* (2006.01)

(52) U.S. Cl.
CPC ..... *A63F 3/0415* (2013.01); *A63F 3/0421* (2013.01); *A63F 2003/00892* (2013.01); *A63F 2003/0418* (2013.01)

(58) Field of Classification Search
CPC ..... A63F 3/0415; A63F 3/0421; A63F 2003/00892; A63F 2003/0418
See application file for complete search history.

(56) References Cited

U.S. PATENT DOCUMENTS 4,155,556 A * 5/1979 Falcione ..... A63F 3/0415 273/239
5,740,243 A 4/1998 Rehm
8,079,592 B1 12/2011 Butler
8,388,426 B2 3/2013 Tackett
2007/0255780 A1 11/2007 Barton
2008/0039168 A1* 2/2008 Wu ..... A63F 3/0415 463/9
2008/0161106 A1 7/2008 Morris

FOREIGN PATENT DOCUMENTS

WO WO 2012/138893 A2 10/2012
WO WO 2013/075097 A2 5/2013

OTHER PUBLICATIONS

International Patent Application No. PCT/EP2013/074618; Written Opinion; dated Oct. 29, 2015; 9 pages.
International Patent Application No. PCT/EP2013/074618; The Int'l Search Report and the Written Opinion; dated Oct. 31, 2014; 24 pages.

* cited by examiner

*Primary Examiner* — Jasson Yoo
(74) *Attorney, Agent, or Firm* — Baker & Hostetler LLP

(57) ABSTRACT

Systems and methods for solving and generating a mathematical puzzle are presented. A puzzle may comprise areas comprising mystery number regions, pair clue regions interposing pairs of mystery value numbers, and a central clue region located centrally to the mystery number region. Solving a puzzle may comprise deterministic search methods coupled with heuristic approaches. Puzzle generation may comprise adding conforming clues until a puzzle has only one possible solution, the clues chosen based on heuristics for adding clues while minimizing incremental change in puzzle difficulty; or reducing the number of solutions/partial solutions to the puzzle.

58 Claims, 34 Drawing Sheets puzzle configuration
of three areas
1600 puzzle configuration
of five areas
1602 puzzle configuration
of five areas
1604

1702

1704

SYSTEM AND METHOD FOR GENERATING AND USING SOLVABLE PUZZLE FORMS

BACKGROUND

Numerical puzzles such as SUDOKU or FUTOSHIKI may be solved by placing numerical values in empty regions of the puzzle, so that each region is filled in a manner that is consistent with any provided clues and pre-filled values in the puzzle, and conformant to the puzzle's logical rules. Such puzzles are not mathematical puzzles in that they do not require any mathematical problems to be solved to complete the puzzles. Whether numerical or mathematical, such puzzles may be embodied on printed mediums such as paper or other manufactured objects, or in computer programs that allow users to play the puzzle. Issues faced by the producers of such puzzles may involve generating new puzzles. For some types of mathematical puzzles, it may be difficult or impossible to generate puzzles without resorting to computer-based techniques.

BRIEF DESCRIPTION OF THE DRAWINGS

FIG. 12 is a flowchart depicting an embodiment of a process for choosing areas within a puzzle to add clues to.

DETAILED DESCRIPTION OF ILLUSTRATIVE EMBODIMENTS

Figure 1A:
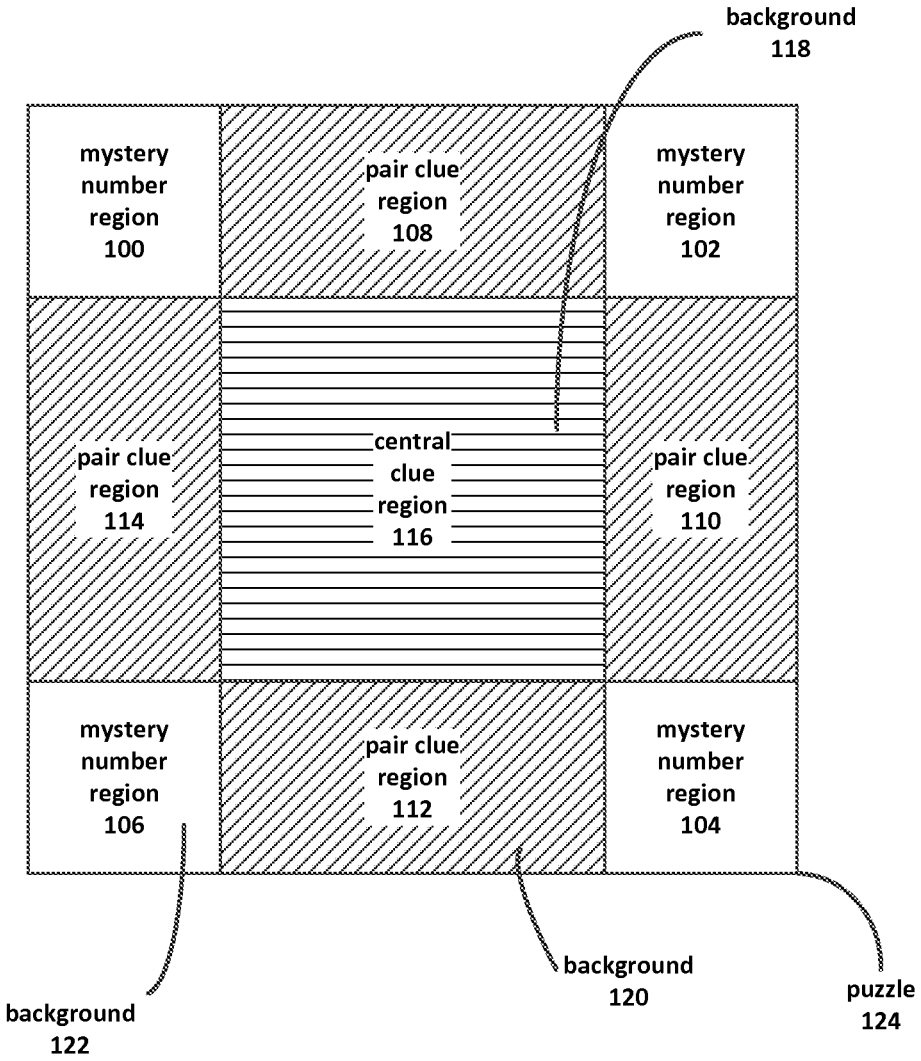
FIGS. 1A, 1B, 1C, 1D, 1E and 1F are block diagrams depicting embodiments of puzzle configurations comprising a single area of mystery number regions interposed by pair clue regions and containing a central clue region.

A puzzle may be comprised of one or more geometric areas, each geometric area comprising a number of mystery number regions located at separate areas along the geometric area, four pair clue regions in which each pair clue is arranged on an edge of the geometric area and interposes two mystery number regions, and a central clue region that is surrounded by the mystery number regions and the pair clue regions. The mystery number regions may initially be blank, to be filled in by a user based on clues to be found in some of the pair clue regions and the central clue region.

A clue in a pair clue region governs permissible values for the two mystery number regions the pair clue region interposes. A clue in a central clue region governs permissible values for the three or more mystery number regions the central clue region is central to. A "plus clue" before or after a value indicates that the values placed in the associated mystery number regions should add up to the value supplied by the plus clue. A "times clue" before or after a value indicates that the product of the values placed in associated mystery number regions should be equal to the value supplied by the times clue.

FIGS. 1A-1F depict minimal examples of embodiments of a puzzle conforming to the rules and characteristics described herein. A geometric puzzle 124, which may be described as a single-area puzzle, may be divided into various regions including mystery number regions 100, 102, 104, and 106, pair clue regions 108, 110, 112, and 114, and central clue region 116. Mystery number regions 100, 102, 104, and 106 may be associated with background 122, pair clue regions 108, 110, 112, and 114 may be associated with background 120, and central clue region 116 may be associated with background 118. Backgrounds 118, 120, and 122 may be differentiated with respect to each other through properties such as color, patterns, textures, and so on. In other embodiments a uniform background may be employed.

As further explained below, in embodiments, the puzzle may have four rules, as follows:

Rule 1. Mystery numbers are whole number and have to be within a chosen range, R. For example, an R=9 puzzle has mystery numbers that range from 1 to 9, an R=12 puzzle has mystery numbers that range from 1 to 12, an R-15 puzzle has mystery numbers that range from 1 to 15, etc.

Rule 2. A mystery pair, two mystery numbers adjacent to one another, i.e., on either side of a pair clue region, can only occur once in a puzzle.

Rule 3. Rule 3 is actually an exception to Rule 2. A mystery pair may be repeated in a puzzle more than once if the mystery pairs are composed of identical mystery numbers and together they form a specified shape, such as four identical mystery numbers forming a square, or three identical mystery numbers forming a triangle, etc. Such specified shapes formed from identical mystery numbers can only occur once in a puzzle, but not all puzzles have such shapes.

Rule 4. Each puzzle can only have one solution, i.e., one set of mystery numbers that correctly complete the puzzle.

Figure 1B:
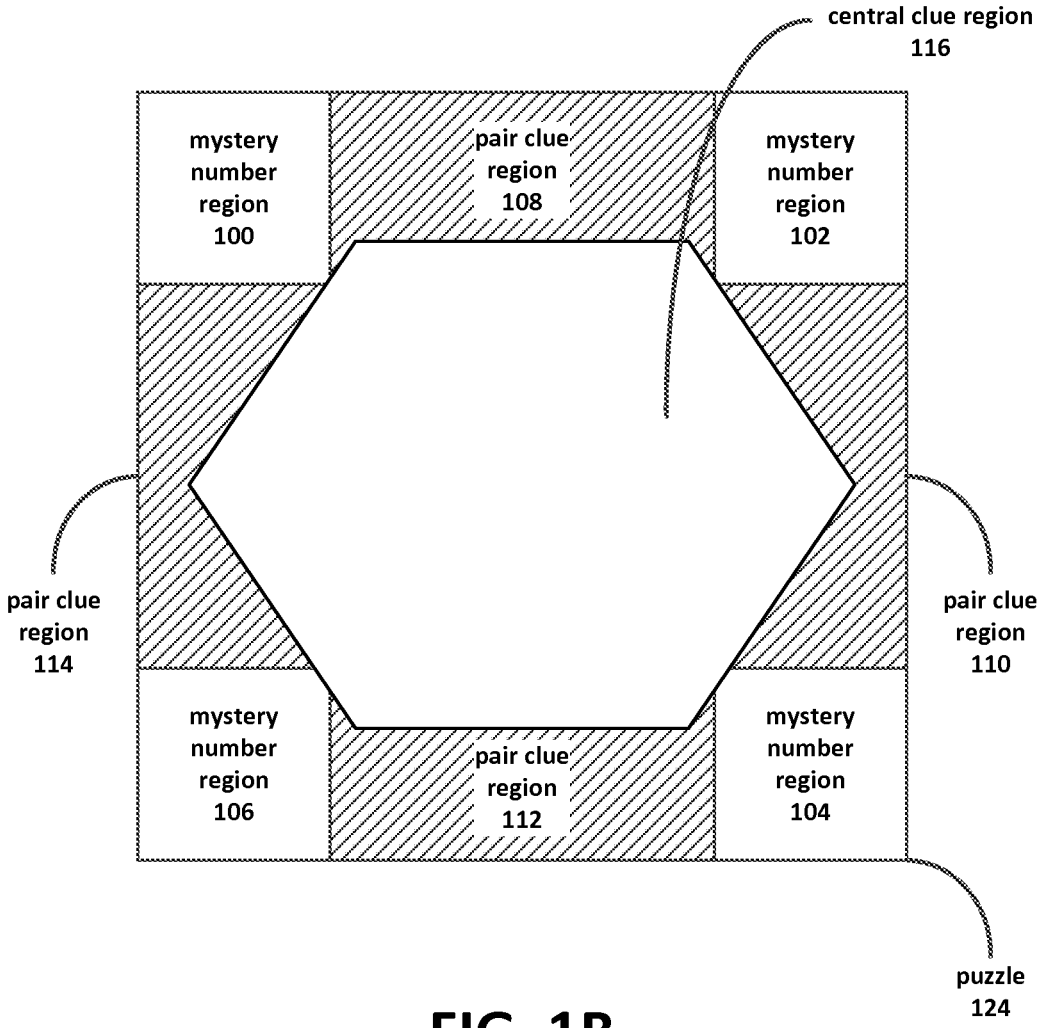
Figure 1C:
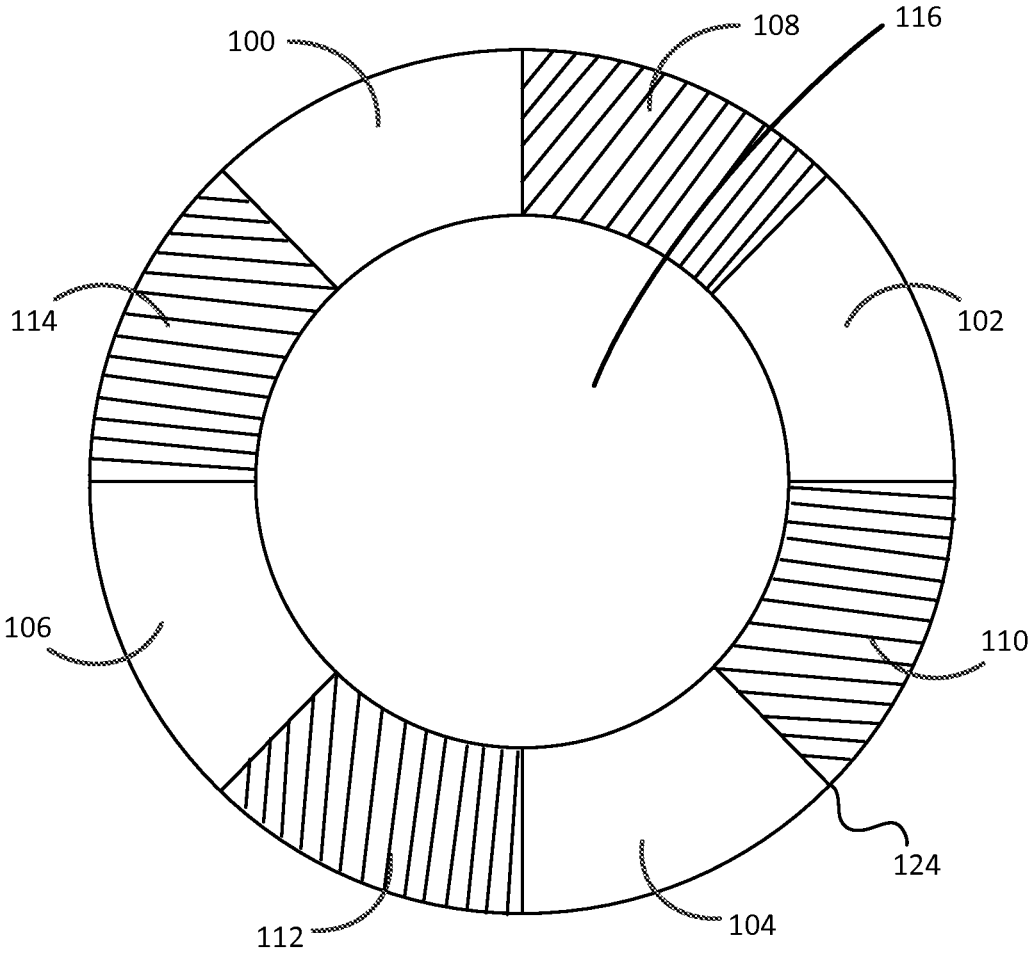
Figure 1D:
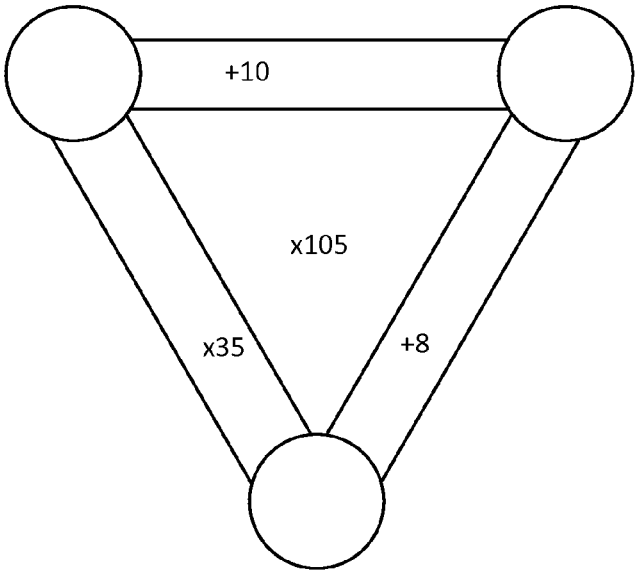
Figure 1E:
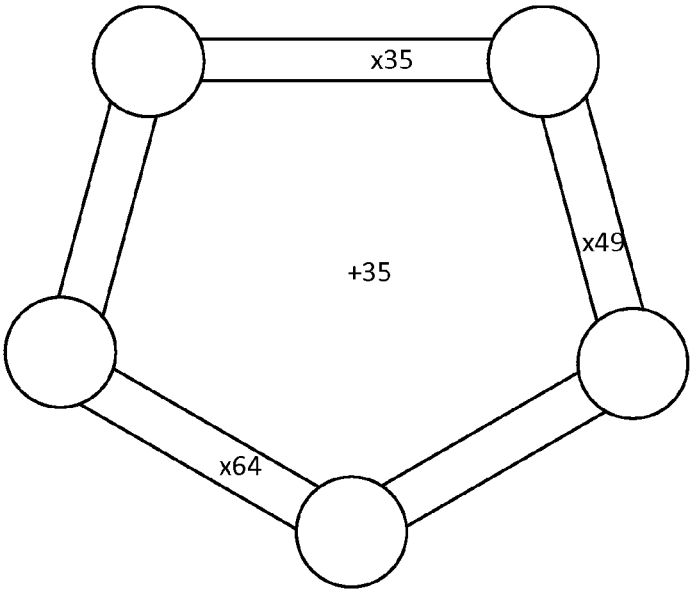
Figure 1F:
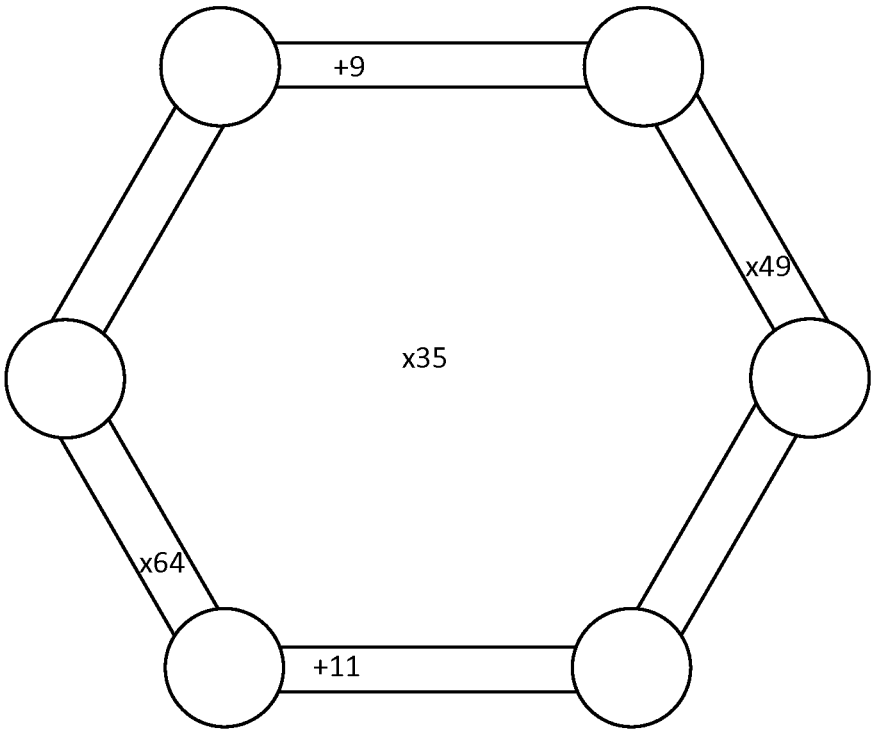

For puzzles with or without central clue regions, the central clue regions, mystery number regions and pair clue regions can have many different shapes. As illustrated in the embodiment depicted in FIG. 1A, central clue region 116 is square-shaped, as are mystery number regions 100, 102, 104 and 106, while pair clue regions 108, 110, 112 and 114 are rectangular-shaped, so as to fill the space between the mystery number regions along the edges of the central clue region 116. FIG. 1B illustrates an embodiment where the central clue region 116 is a polygon-shaped area, the mystery number regions 100, 102, 104 and 106 are also polygon-shaped areas, as are the pair clue regions 108, 110, 112 and 114. It is not necessary that each of the mystery number regions or each of the pair clue regions be shaped exactly the same for puzzles with central clue regions, as long as they maintain a certain geometric symmetry so it is clear where the mystery number regions are located versus the pair clue regions and the central clue region. The purpose or function of a particular region will also be assisted by the presence or absence of clues. Hence, while mystery number regions 100, 102, 104 and 106 each have the same shape, pair clue regions 108 and 112 are shaped differently from pair clue regions 110 and 114, and a user may be able to discern the purpose of a region of a particular shape by the presence or absence of clues within that type of shape.

Also, while the geometric puzzle 124 depicted in FIG. 1B has a square or rectangular exterior shape, the exterior shape need not be square or rectangular and could be round, triangular, oval, polygonal, or even randomly-shaped and generated by a random shape generator. For example, in the embodiment of the geometric puzzle 124 illustrated in FIG. 1C, the exterior shape is round, with the central clue region 116 being round and surrounded by a ring comprised of the mystery number regions and the pair clue regions, but the central region could still be round and surrounded by an exterior set of mystery number regions and pair clue regions forming a square exterior with a circular interior. While it may be desirable to only construct puzzles in shapes that can be repeated and combined together, such as those used in FIGS. 1A, 1B and 1D-1F, FIG. 1C illustrates that any shape or size may be used, although doing some may limit certain applications for the puzzle, such as linked or repeated puzzle tiles. In more complicated puzzles, further discussed below for example with respect to FIGS. 4A-4E, including multiple geometric puzzle pieces, certain geometric shapes may be harder to use, but since a specific geometry is not required, the resulting puzzle could be formed of many interesting shapes. As further noted below, puzzles with central clue regions may also be combined together and/or with puzzles without central clue regions, such as those illustrated in FIGS. 4G and 4H.

Returning to FIG. 1A, mystery number regions 100, 102, 104, and 106 may each be associated with numbers in a range of 1 to R, where R can be any positive integer greater than one, such as 5, 9, 12, 15, and so forth. A mystery number region may be prepopulated with a number in the range of 1 to R, that is visible to a user of the puzzle, or initially left blank, which is referred to as "hidden" herein because by the time the puzzle is generated, each mystery number is known and is just waiting to be correctly filled in by the user.

Figure 2:
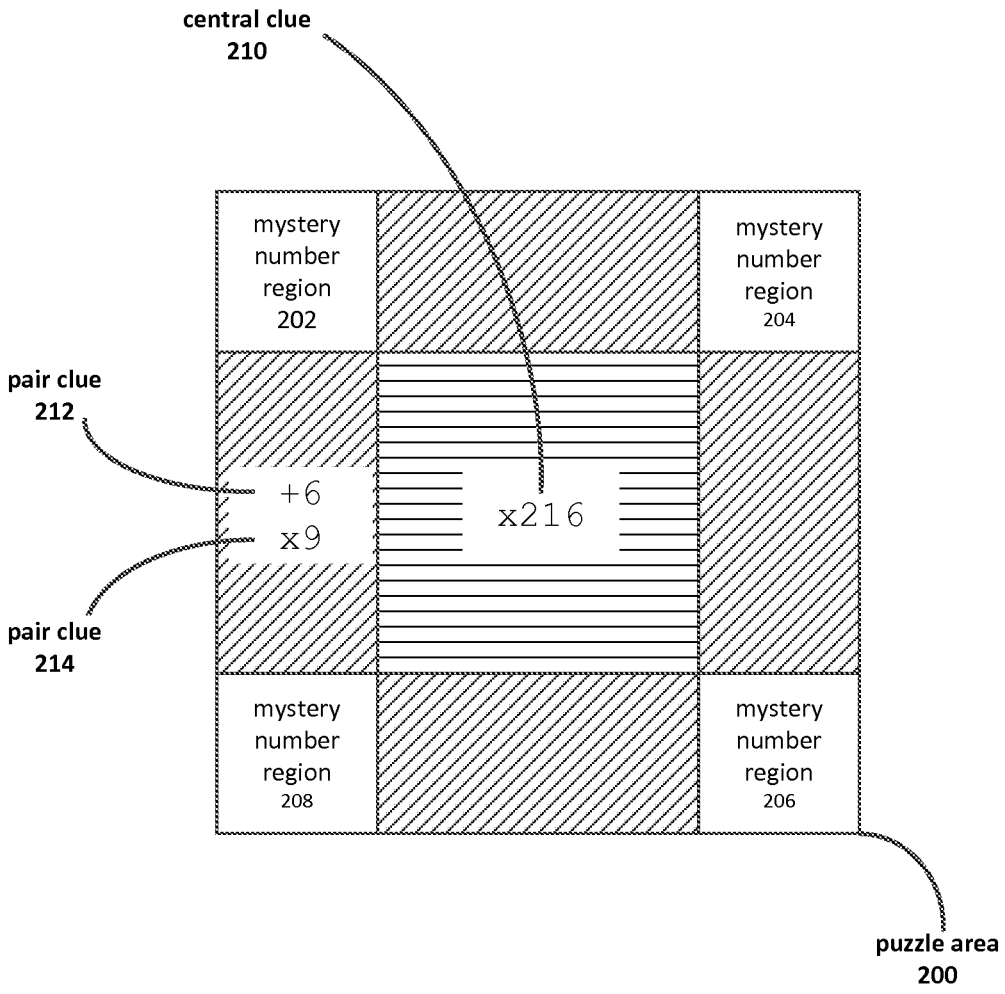
FIG. 2 is a block diagram depicting clues governing values that may be entered into a mystery number region.

Clues within a pair clue region or central clue region constrain the values that may be placed in a mystery number region. FIG. 2 depicts an example of clues constraining permissible values. Pair clue 212 ("+6") and pair clue 214 ("×9") both govern permissible values for mystery number regions 202 and 208. For example, the sum of mystery number region 202 and mystery number region 208 must equal 6, while the product of mystery number region 202 and mystery number region 208 must equal 9. At the same time, central clue 210 ("×216") governs permissible values for all diagonally adjacent mystery number regions 202, 204, 206, and 208. For example, the product of mystery number region 202, mystery number region 204, mystery number region 206 and mystery number region 208 must equal 216. While FIG. 2 depicts a square puzzle area 200, as discussed above, other shapes are possible. For sake of simplifying the disclosure herein, however, much of the remainder of this disclosure may reference square or rectangular-shaped regions when referring to the central region being used within puzzles with the understanding that the present disclosure is not so limited, and the so-called "square" may actually be a triangle, pentagon, hexagon, etc.

Figure 3:
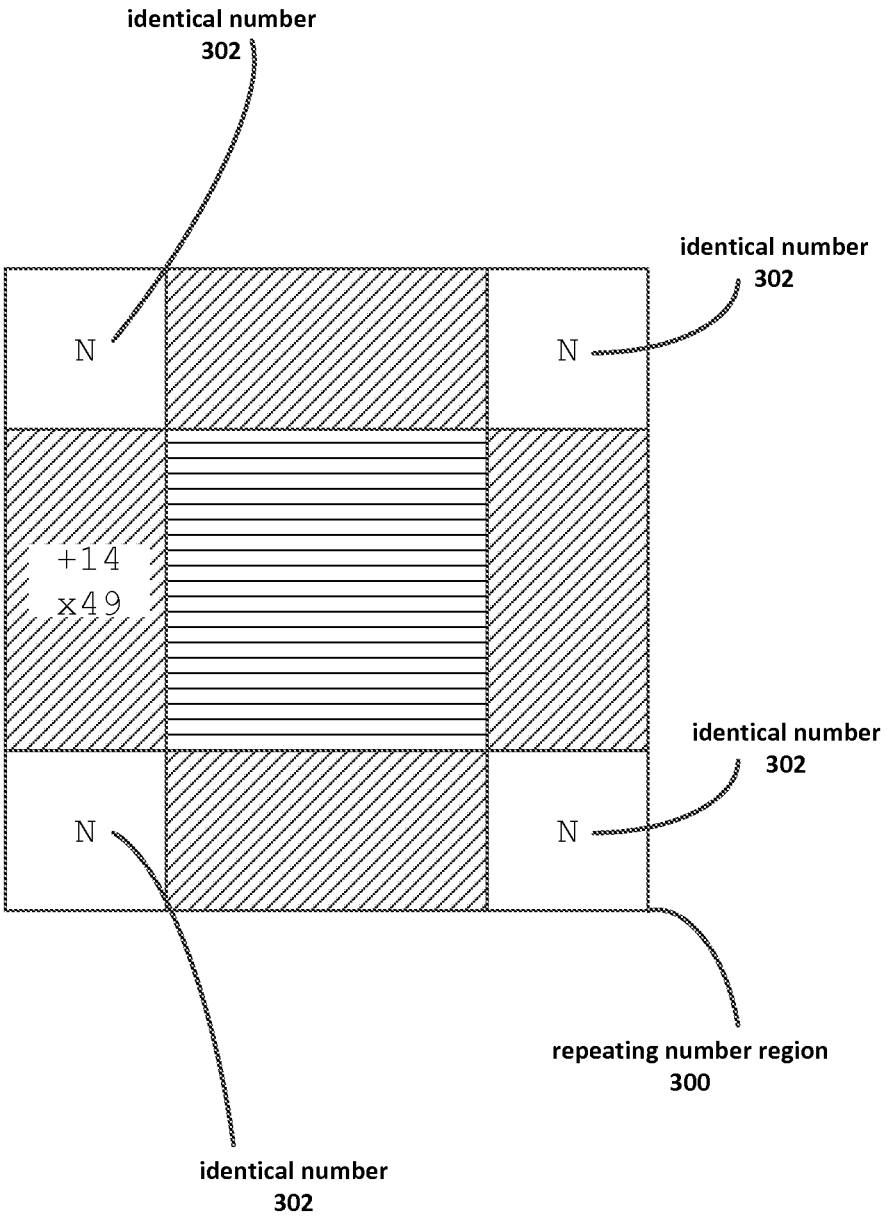
FIG. 3 is a block diagram depicting a repeating number region.

In some embodiments, as noted above, a combination of numbers or values assigned to a mystery number region may occur only once in a given puzzle. In some embodiments, combinations of pairs numbers or values for mystery number regions may occur only once in a puzzle. Embodiments may allow an exception to this rule where identical values may be assigned to mystery numbers within an area having a specified shape or pattern. This pattern, which may be referred to as a "repeating clue region," may occur only once in any puzzle, and not all puzzles have this pattern. An example of a repeating clue region 300 is depicted in FIG. 3, comprising a square-shaped set of four identical numbers 302 in each corner of puzzle 304.

Figure 4A:
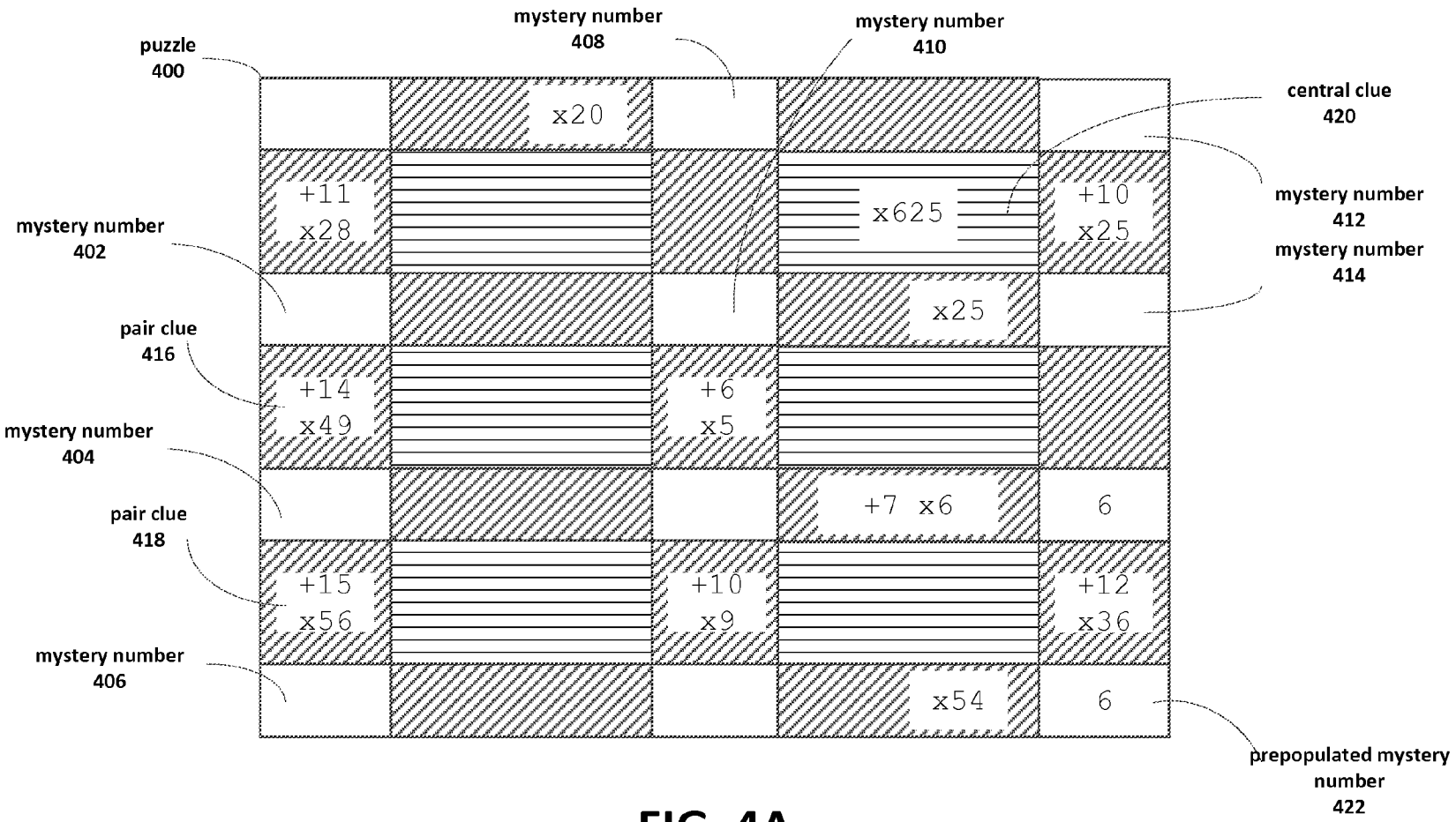
FIGS. 4A, 4B, 4C, 4D and 4E are block diagrams depicting embodiments of puzzle configurations composed of repeating areas comprised of mystery number regions and pair clue regions surrounding a central clue region.
Figure 4B:
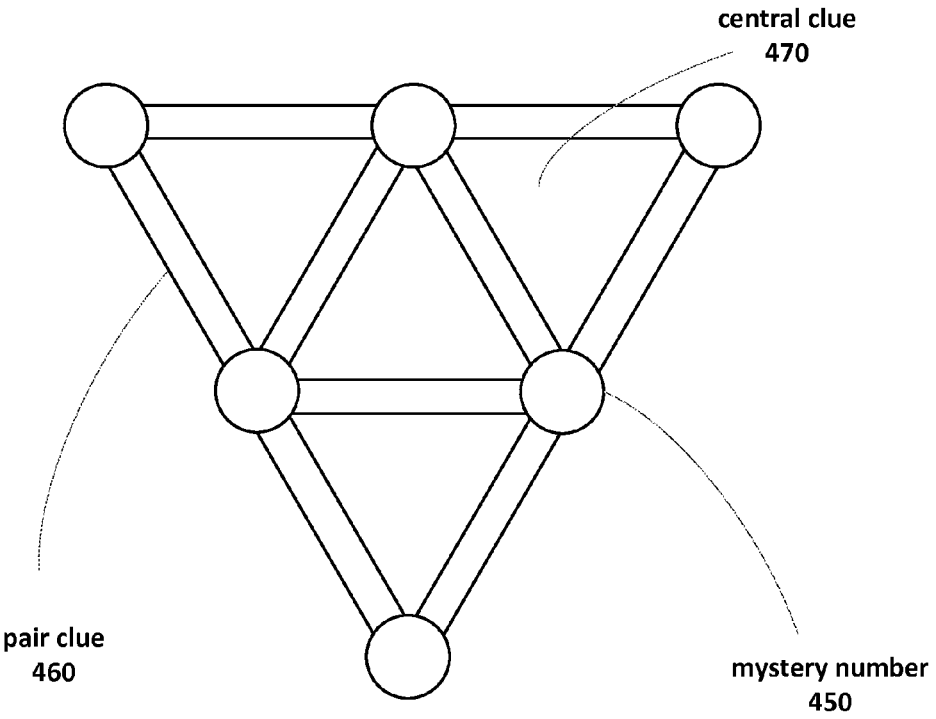
Figure 4C:
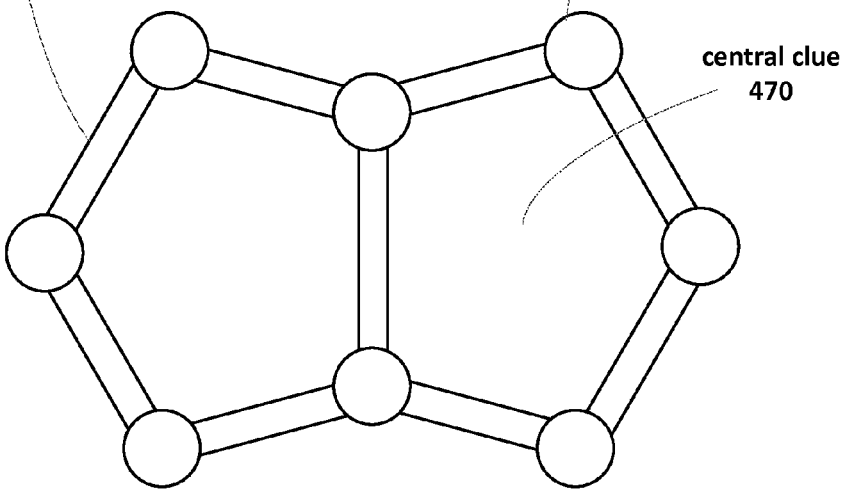
Figure 4D:
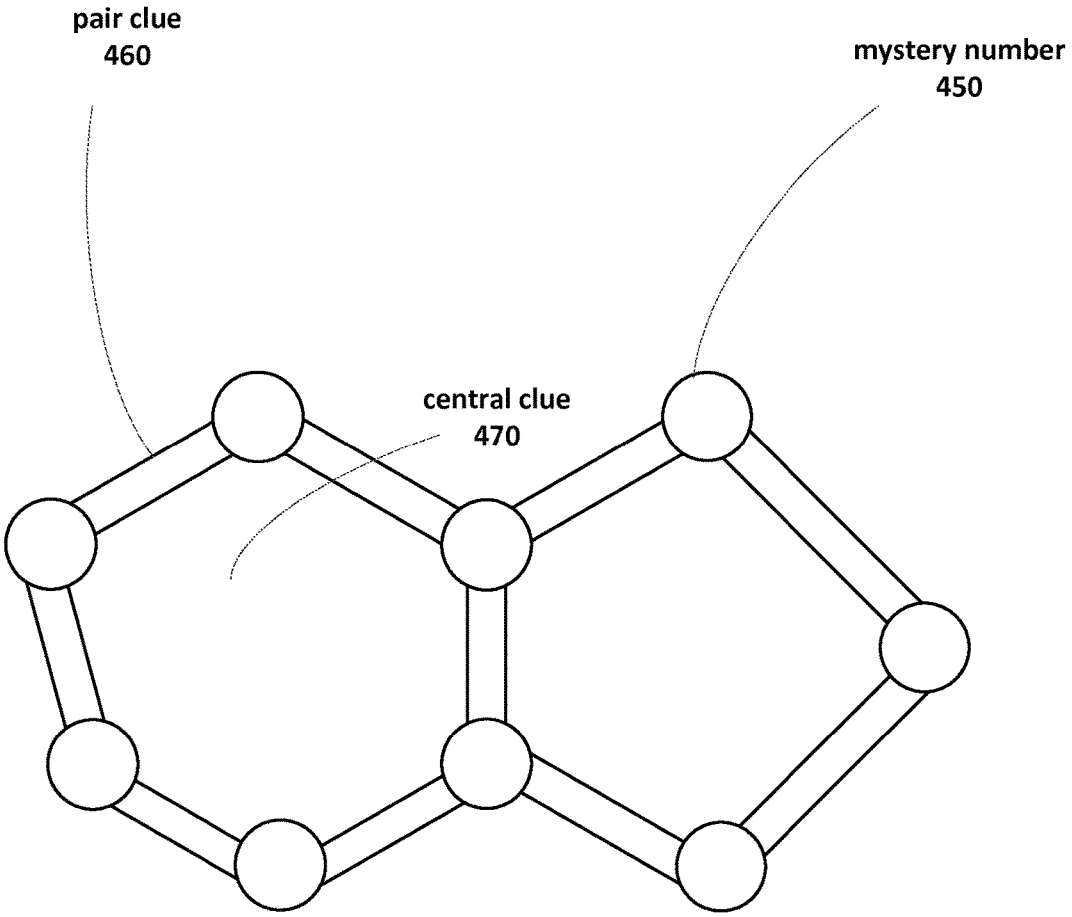
Figure 4E:
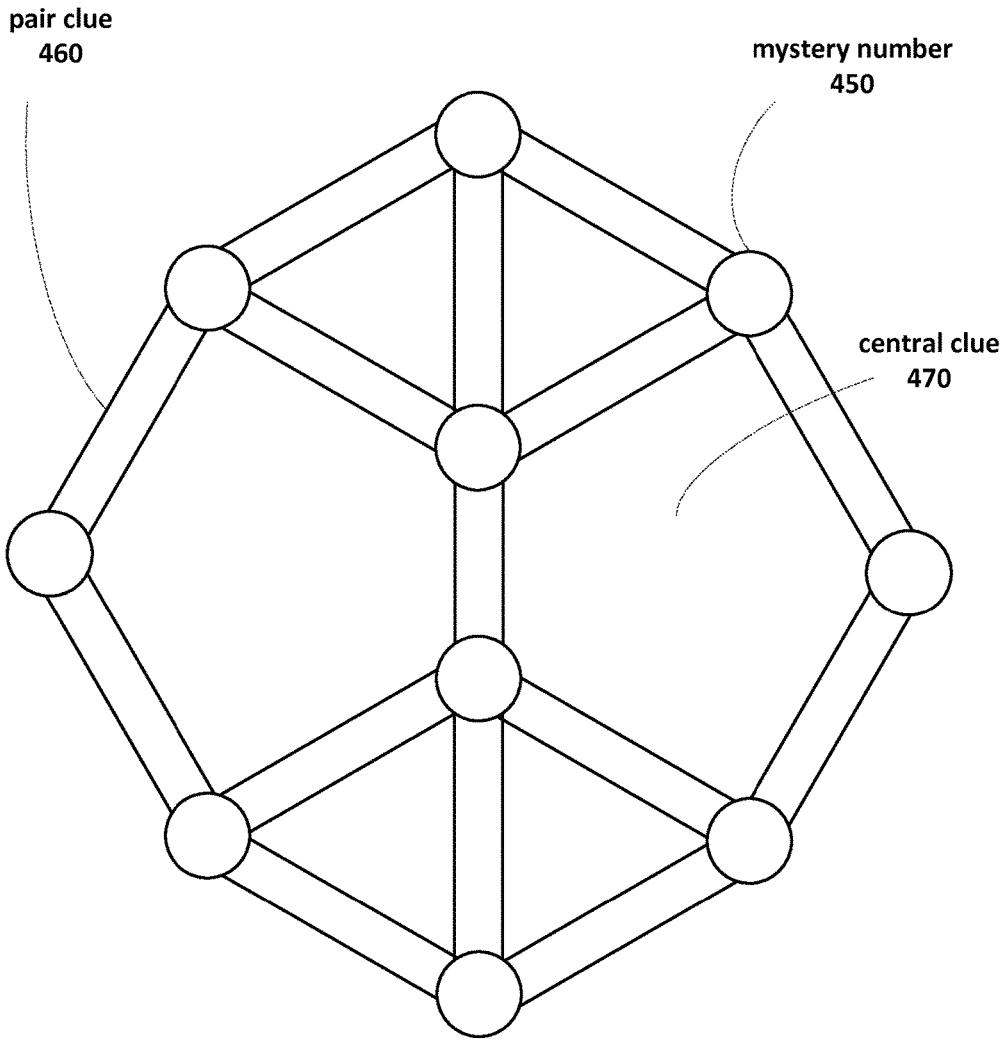

In an embodiment, a given puzzle configuration may have one and only one solution. A puzzle configuration comprises an arrangement of rectangular-shaped regions and a set of clues. FIG. 4A provides one non-limiting example of a puzzle configuration. Puzzle 400 may comprise various mystery numbers such as 402, 404, 406, 408, 412, and 414, which may be filled in to complete puzzle 400. Prepopulated mystery number 422 is an example of a mystery number that has been pre-filled with a value in order to provide additional clues to solving the puzzle.

Although FIG. 4A is described herein with reference to a rectangular-shaped puzzle configuration and other embodiments are described herein in the context of square puzzle areas and repeating square puzzle configurations, other embodiments may once again be based on puzzle configurations of many shapes and configurations. For example, FIGS. 4B-4E illustrate various puzzle configurations comprised of a plurality of mystery numbers regions 450 and a plurality of pair clue regions 460 arranged in different shapes, such as triangles, pentagons, sexagons and various combinations of those shapes, with a central clue region 470 at the center of each shape. Obviously, many other combinations and repeating puzzle configurations are possible in accordance with embodiments, such that puzzle areas and repeating puzzle area configurations may be formed of any polygon of any size (with various numbers of edges or sides), convex, concave, cyclic, etc. Examples shown herein show central clue areas that are formed from triangles, pentagons, hexagons, etc., that may be readily joined together to cover any surface, and not just flat surfaces. For instance, these polygons of different sizes may be joined together to cover curved surfaces such as a sphere, toroid, baseball-shape, etc. While the present disclosure shall use the term "square" for central areas for the ease of illustrating the exemplary algorithms and processes described herein, the algorithms and processes described are all equally applicable to any puzzle configuration, such as "non-square" ones depicted herein.

A pair clue, such as 416, may be adjacent to mystery numbers 402 and 404, in the vertical arrangements depicted in FIGS. 4A-4E. Embodiments may employ other arrangements such as horizontal or diagonal. A pair clue, such as 416, may be initially populated with zero, one, or two clues. If present, the clues may comprise a plus clue such as "+14" and/or a times clue such as "×49." These clues are both depicted in pair clue 416. The mystery numbers 402 and 404 can only be 7 and 7 because only 7+7=14 and 7×7=49. Similarly, pair clue 418 may be initially populated with clues such as "+15" and "×56." Hence, pair clues 416 and 418 constrain the permissible values for mystery numbers 402, 404, and 406. For example, with the clues provided in FIG. 4 mystery values 402, 404, and 406 should be filled with the values 7, 7, and 8, respectively.

A central clue 420 may be initially populated with zero, one, or two clues. In FIG. 4, for example, central clue 420 is depicted as having a times clue "×625" but might have had a plus clue in addition to or instead of a times clue, or have had no clues at all. A central clue constrains the values of mystery numbers around it. For example, central clue 420 constrains the permissible values for mystery numbers 408, 410, 412, and 414, which given central clue "×625" should each be filled in with the value "5."

A puzzle may comprise one or more jokers or wildcard regions. Joker or wildcard regions may represent any value. Embodiments may also allow for variants of wildcards, such as numbers within a range or from a set of possible numbers.

Embodiments may generate grids suitable for use as puzzles of the types described herein. Divide and conquer principles may be combined with search and optimization algorithms to generate grids of various sizes and configurations. The grids may be validated for correctness, adherence to rules and constraints. Embodiments may also validate grids to ensure that the generated puzzle has only one solution for a given configuration.

Embodiments may generate minimal puzzles for various grid configurations. A minimal puzzle may be defined as a grid in which clue configurations are such that, for a given number of central clues present in the grid, the number of pair clues present in the grid is minimal. In this context, minimal may be defined so that if any pair clue is removed from the grid, there is no longer a unique solution to the puzzle.

Figure 4F:
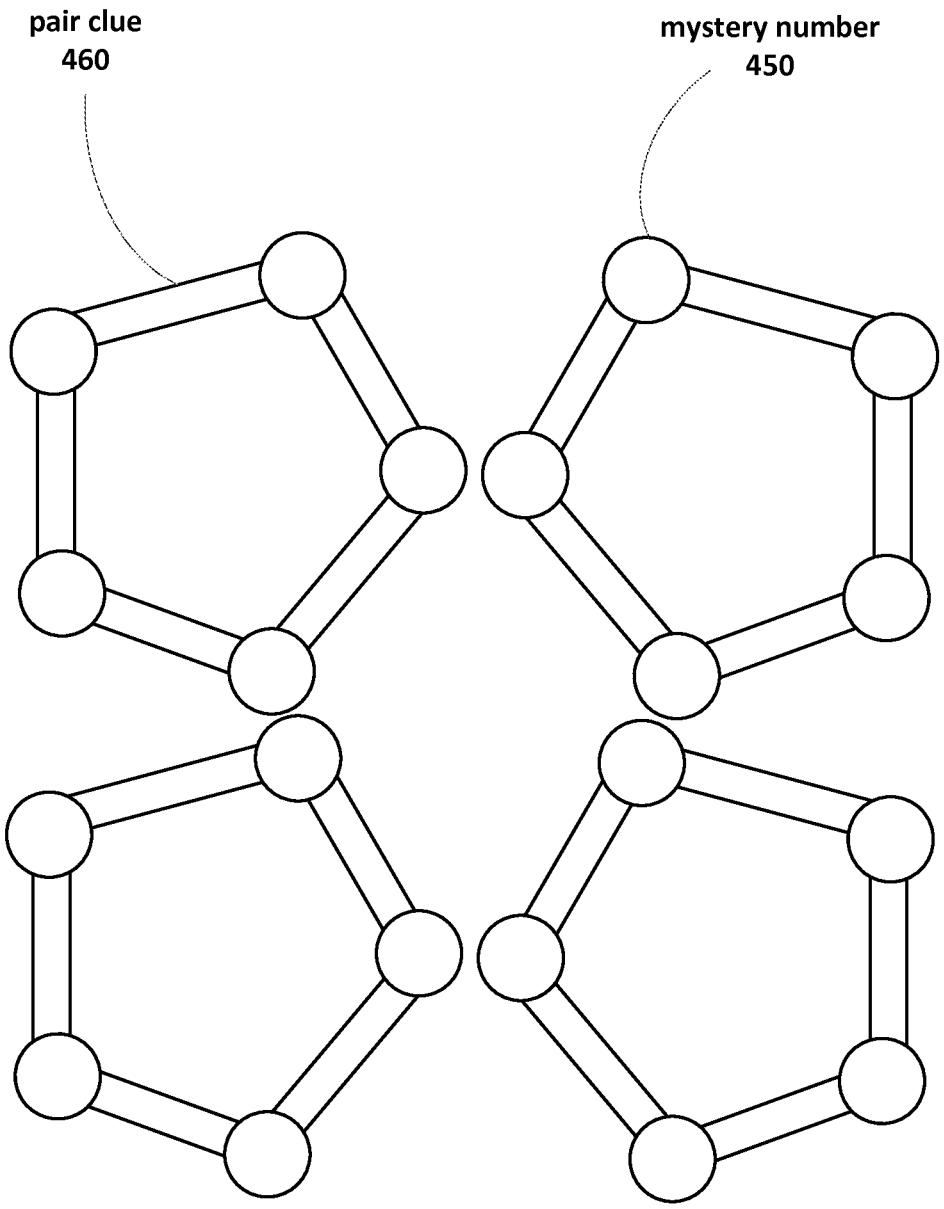
FIGS. 4F, 4G and 4H are block diagrams depicting embodiments of puzzle configurations composed of mystery number regions and pair clue regions.
Figure 4G:
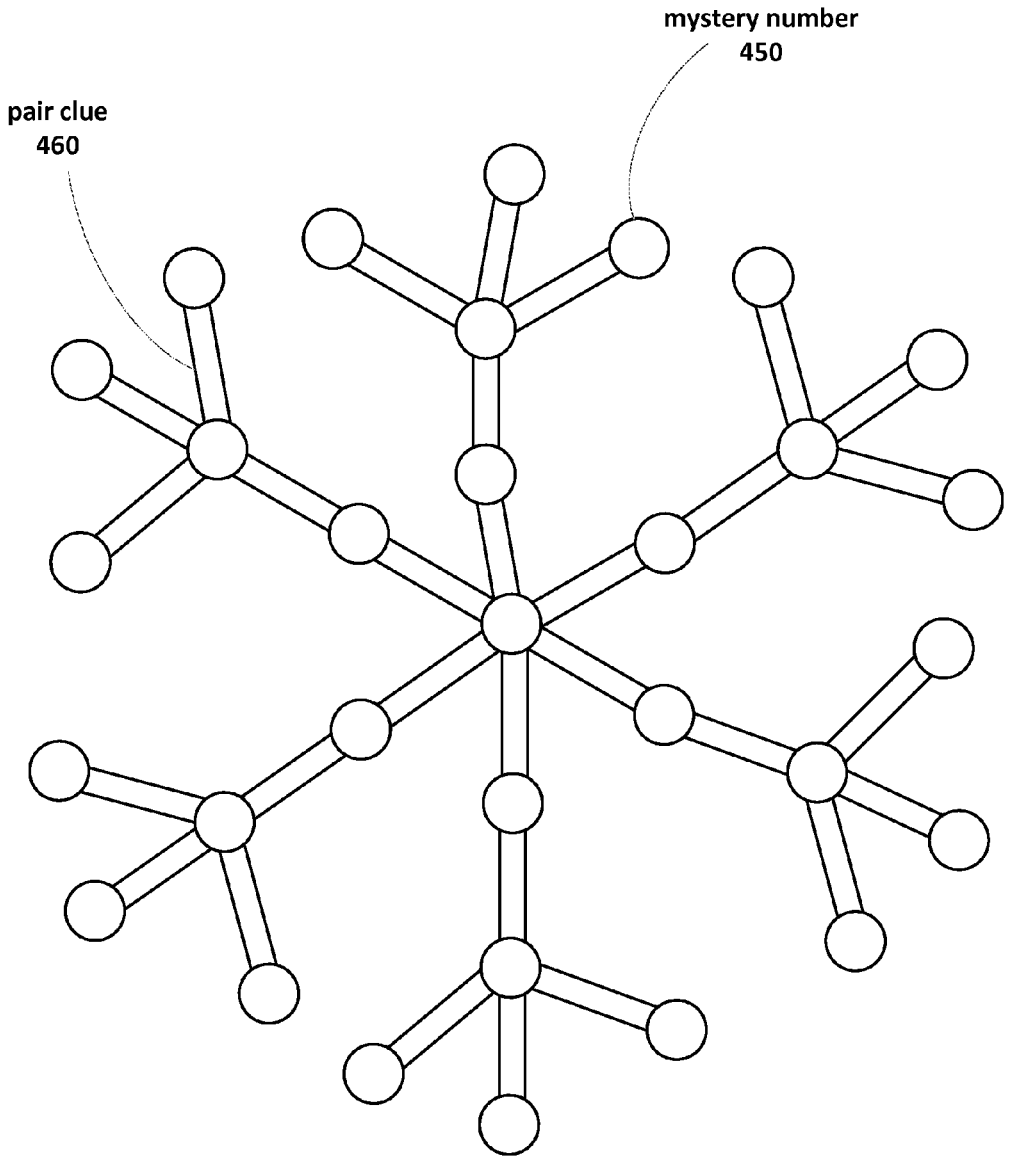
Figure 4H:
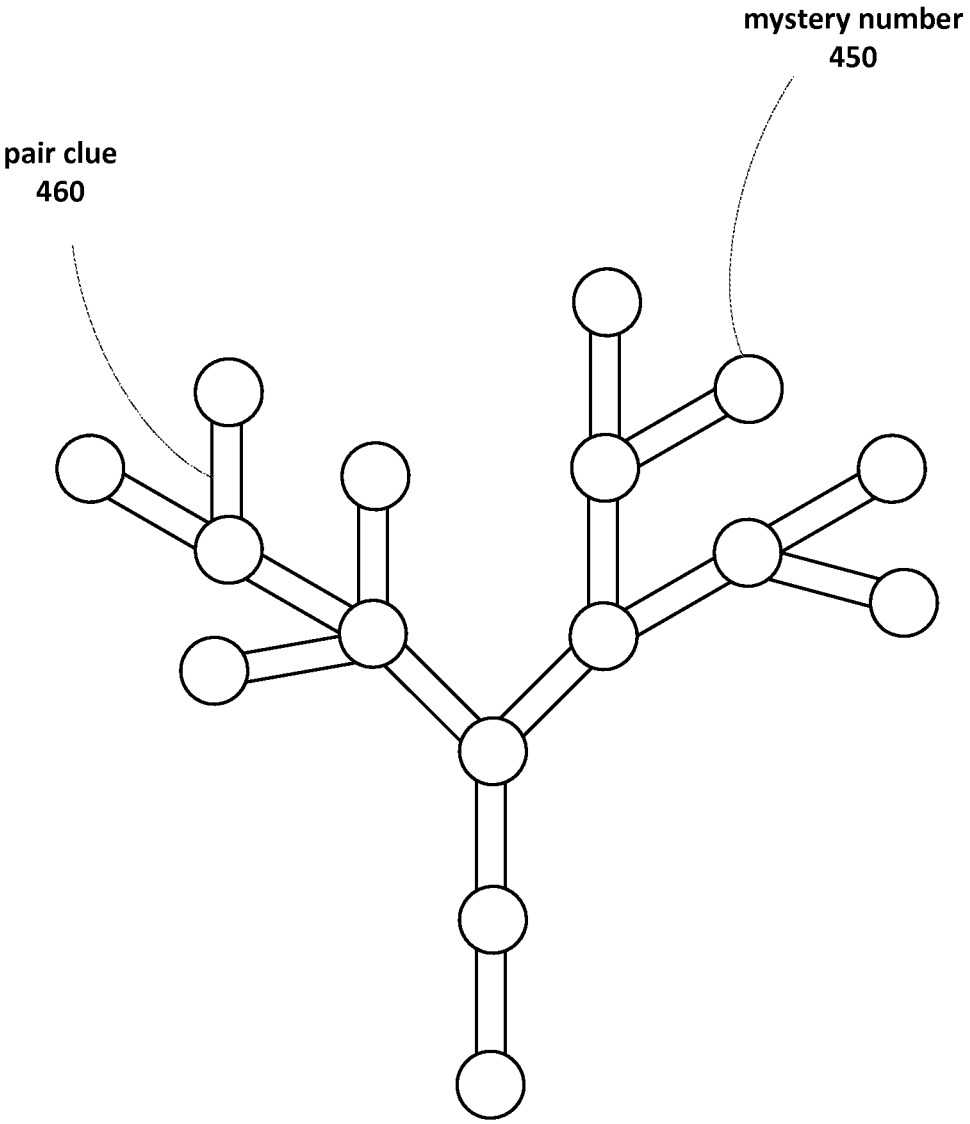

Additional embodiments of puzzles that may not include central clue regions are depicted in FIGS. 4F, 4G and 4H, which illustrate puzzle configurations comprised of mystery number regions 450 and pair clue regions 460, which may or may not include central clue regions. For example, the puzzle configuration of FIG. 4F could be comprised of four puzzle areas that are adjacent to one another, but do not share mystery numbers 450 or pair clue numbers 460, and may or may not have a central clue region. Puzzle configurations that do not include central clue regions may be easier, in some cases, than puzzles with central clue regions, making the puzzles better suited for certain age groups. The adjacent or interconnected mystery numbers and pair clues also enable the puzzles to be configured in more shapes, such as polygons, linear non-polygons and various odd shapes, such as trees, dinosaurs, cartoon characters, etc. FIG. 4G illustrates a puzzle having a star configuration, while FIG. 4H illustrates a puzzle having a tree configuration.

As previously noted, multi-puzzles or composite puzzles may also be constructed where smaller puzzles are combined together to form larger puzzles or specific shapes, while still abiding by the four rules for the puzzles, as noted above. This allows bigger and more interesting puzzle shapes with small values of R to be constructed without running out of unique pairs for each puzzle. For example, the puzzle of FIG. 4F illustrates an example of what could be four separate puzzles joined together to form what appears to be one larger puzzle.

Figure 5:
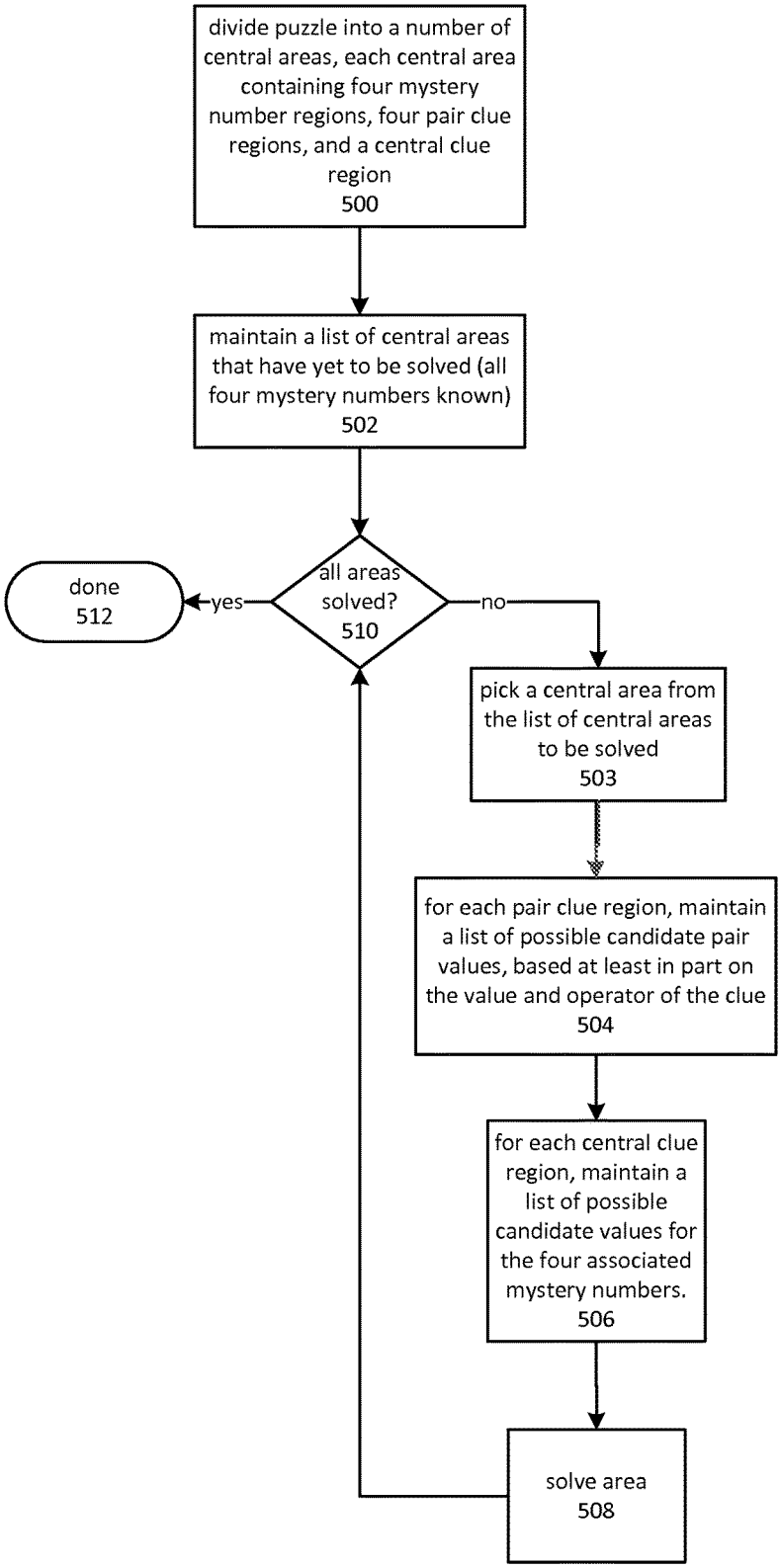
FIG. 5 is a flowchart depicting an embodiment of a divide-and-conquer approach to solving a puzzle.

Before a puzzle configuration can be made available to users, the puzzle configuration must be designed, mystery numbers and/or clues must be inserted, and the puzzle must be solved to ensure there is only one solution to the puzzle. Embodiments for solving puzzles may employ various combinations of divide and conquer algorithms, search and optimization algorithms, and heuristic methods to solve a particular puzzle. FIG. 5 depicts an embodiment of a divide and conquer approach to solving a puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

Operation 500 depicts dividing the puzzle to be solved into a number of central or square areas, each square area containing three or more mystery number regions, four pair clue regions, and a square clue region. An example of such a region is depicted in FIG. 1A.

As depicted by operation 502, embodiments may maintain a list of central or square areas that are yet to be solved. A square area (recall that "square" may refer to an area of other shapes herein) may be considered solved when a valid number has been assigned to all three or more mystery number regions. The number three forms the minimum number of mystery numbers for a central area because there must be three sides to a central area for the area to be central, i.e., surrounded. If there are central areas that are yet to be solved, the no branch of operation 510, then a central area from the list of central areas to be solved may be selected in operation 503.

Embodiments may maintain a list of possible candidate pair values for each pair clue, as depicted by operation 504. For example, referring again to FIG. 1A, a list of two-valued tuples could be maintained in association with pair clue region 108, corresponding to candidate values for mystery number regions 100 and 102. The list may be based in part on the R-value of the puzzle and on the value and operator of the clue. The operator of the clue refers to whether the clue is a plus (+) clue or a times (×) clue. For example, in a puzzle where R=9 with a "×12" pair clue, the list of possible candidate pair values could comprise (3,4), (4,3), (2,6), and (6, 2). For a "+9" clue, the list could comprise (4,5), (5,4), (3,6), (6,3), (2,7), (7,2), and (1,8), (8,1).

Operation 506 depicts maintaining a list of possible candidate pair values for a central clue region within the central area. For example, for an R=9 puzzle and a central clue of "×60" the list could comprise (6, 5, 2, 1), (5, 4, 3, 1), and (5, 3, 2, 2), and various permutations thereof.

The central area may be solved, as depicted by operation 508, by checking and eliminating illegal values from the lists of possible values. Embodiments may employ recursive algorithms to examine and eliminate illegal values. Breadth-first, depth-first, or various combinations thereof may be used by some embodiments. Various state data may be retained at each step of the recursion. Some embodiments may employ iterative or procedural mechanisms in place of recursive mechanisms. Additional processes and mechanisms, as described herein, may also be employed to solve the central area.

Operation 510 depicts determining whether any additional central areas remain to be solved, and if so continuing to solve central areas through the depicted operations. If all areas have been solved, the process completes as depicted by operation 512. In attempting to solve a puzzle in this manner, it is determined that the puzzle could have more than one solution, it may be necessary to add a mystery number or clue to the puzzle to prevent the puzzle from having the more than one solution.

Figure 6A:
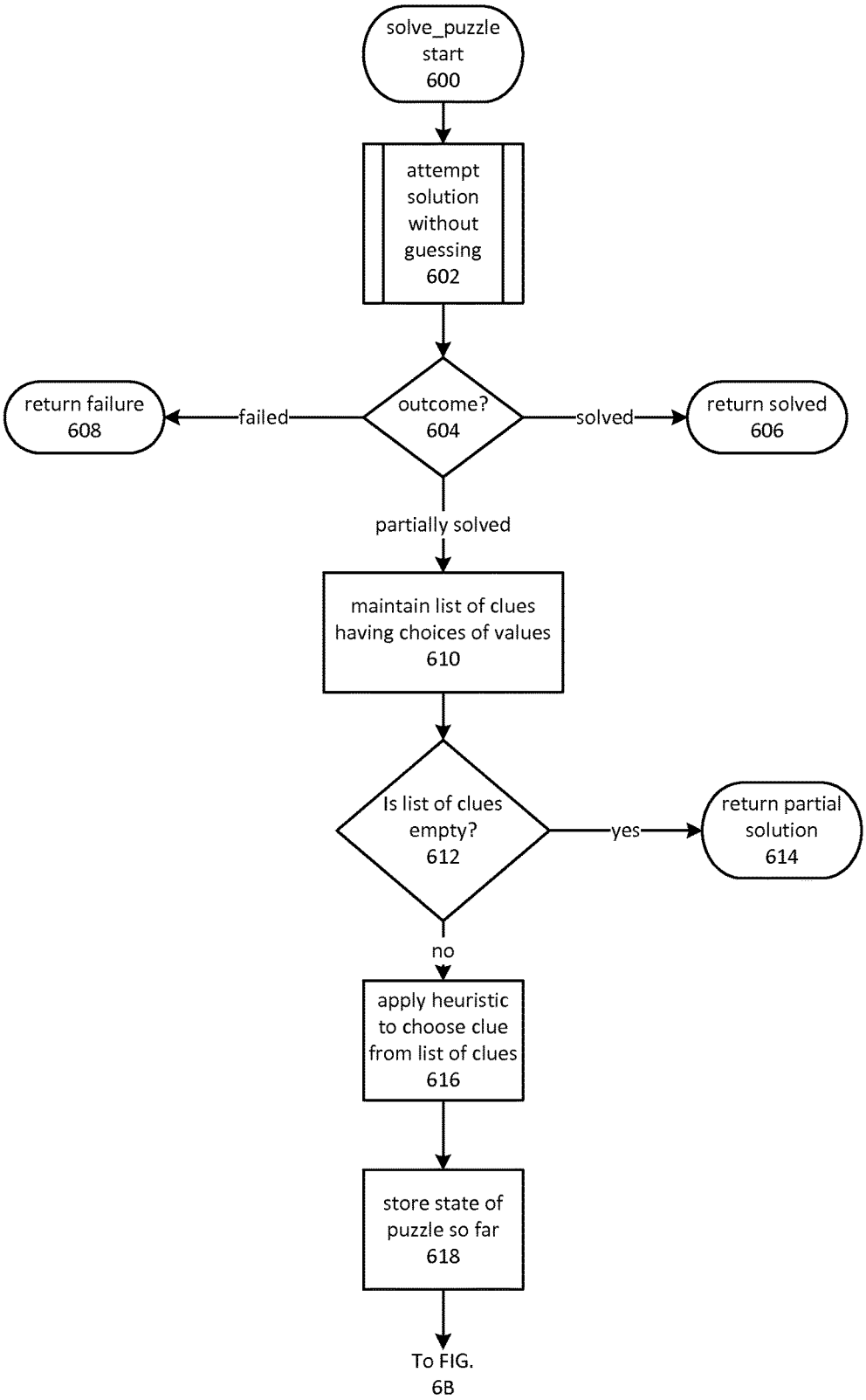
FIG. 6A is a flowchart depicting an embodiment of a process for solving a puzzle using a combination of non-heuristic and heuristic approaches.
Figure 6B:
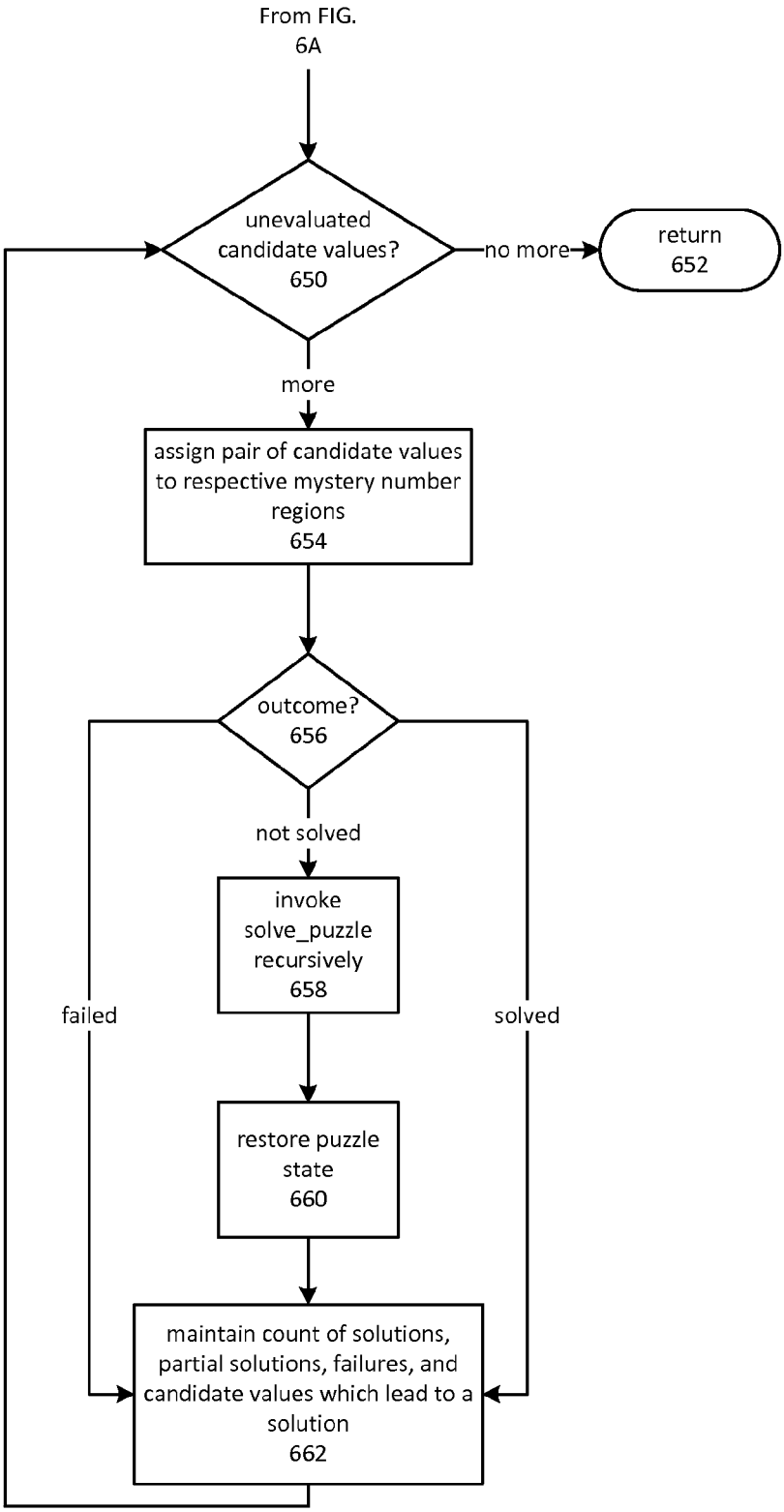
FIG. 6B is a continuation of the flowchart of FIG. 6A.

FIGS. 6A and 6B also depict a process for solving puzzles having central clue regions and, in this example, a square or rectangular configuration. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

Operation 600 depicts what may be considered the start of a procedure entitled "solve_puzzle." Those of ordinary skill in the art will appreciate that this designation is for descriptive purposes, and does not limit the intended scope of the disclosure. In addition, those of ordinary skill in the art will appreciate that the operations depicted in FIGS. 6A and 6B may be embodied in various alternative combinations of circuitry and/or processor-executable instructions, including various approaches to modularity and encapsulation, such as alternative approaches to dividing functionality between various procedures or subroutines.

Operation 602 depicts attempting to solve an area of a puzzle without making guesses, as described herein. An attempt to solve an area of a puzzle may result in one of three outcomes. If the area can be completely solved without guesses, the process may be considered complete as indicated by operation 606. An indicator of success may be provided. If the area could not be solved, the process may also be considered complete, but with an indication of failure, as depicted by operation 608. If the area was only partially solved without using guesses, the process may continue.

Embodiments may maintain a list of clues having choices of values for the corresponding mystery number regions where the corresponding mystery number regions have not yet been determined (or assigned). The list may comprise an entry for each pair clue region having choices of values, and an entry for each diagonal of a central clue region. Operation 610 depicts maintaining the list of clues. The list may be examined, as indicated by operation 612, to determine if further evaluation is needed. If not, a partial solution, as further defined below, may be returned at operation 614. Otherwise the evaluation may continue. Where values have already been determined or assigned for corresponding mystery number regions, in embodiments, there may be no need to maintain a list.

If the puzzle cannot be solved without guessing, then operation 616 depicts applying one of various heuristic approaches to choose a clue from the list of clues. Embodiments may then perform further evaluation on the chosen clue to determine possible solutions pertaining to that clue. Embodiments may store the current state of the puzzle, as depicted by operation 618, prior to performing continued analysis. Embodiments may assign values to various mystery number regions during an attempt to solve the puzzle and to backtrack using previously saved state information.

Embodiments may employ various heuristic methods to choose a clue from the list of clues. One possible heuristic is to choose the clue whose corresponding mystery number regions have the least number of possible candidates.

The process may continue to operation 650 in FIG. 6B. A chosen entry from the list of clues may have a set of candidate values associated with it. For example, if the chosen entry corresponds to the clues +5 and ×6, the list of clues might comprise (2, 3) and (3, 2). Likewise, if the chosen entry corresponds to the clue ×12, the candidate list of clues might comprise (3, 4), (4, 3), (2, 6) and (6, 2). Operation 650 depicts evaluating each candidate value associated with a chosen entry from the list of clues. If all candidate values have been evaluated, evaluation may end.

Operation 654 depicts assigning pairs of candidate values to mystery number regions associated with the candidate values. The outcome of the assignment may then be determined, as indicated by operation 656. The outcome may involve three conditions. First, the puzzle may be solved. Second, the puzzle may not be solved but the assigned values conform to all applicable rules and clues. Third, the assigned values may fail because of a conflict with a rule or clue.

If the puzzle is not solved, but the assigned values conform to applicable rules and clues, the process may continue with a recursive invocation of a solve_puzzle procedure, e.g., operation 600 in FIG. 6A. Embodiments may also employ non-recursive techniques.

After the recursive invocation, the state of the puzzle may be restored so that the next pair of candidate values may be evaluated. This is depicted by operation 660. Various forms of housekeeping may be performed at operation 662, such as maintaining a count of solutions, partial solutions, and failed solutions, as well as candidate values which lead to full or partial solutions.

Figure 7:
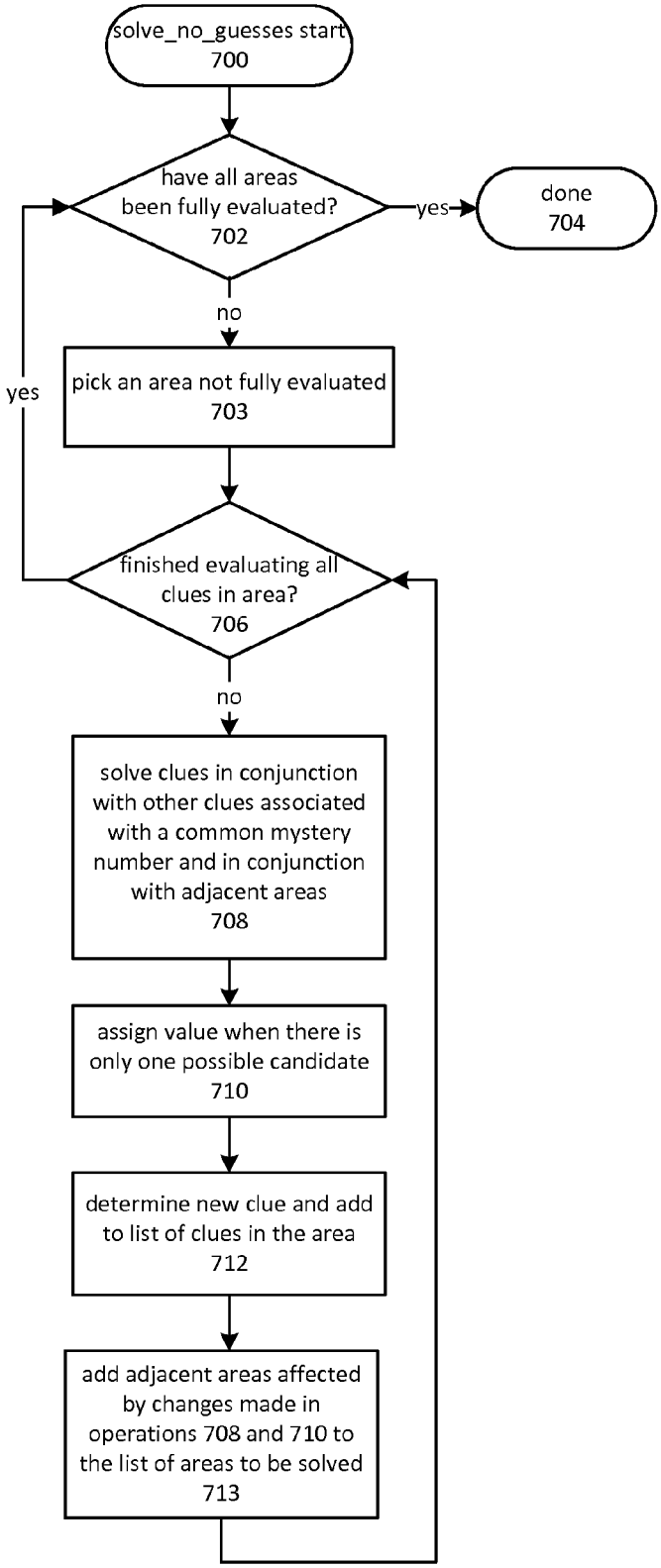
FIG. 7 is a flowchart depicting an embodiment of a deterministic process for solving a puzzle without resorting to heuristic methods.

FIG. 7 depicts a process for solving a central region of a puzzle without guessing. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel. The start of a procedure for solving a central region of a puzzle may be depicted by operation 700. The procedure may be entitled "solve_no_guesses." Those of ordinary skill in the art will appreciate that this designation is for descriptive purposes, and does not limit the intended scope of the disclosure. In addition, those of ordinary skill in the art will appreciate that the operations depicted in FIG. 7 may be embodied in various alternative combinations of circuitry and/or processor-executable instructions, including various approaches to modularity and encapsulation, such as alternative approaches to dividing functionality between various procedures or subroutines.

A puzzle may be divided into a number of areas. Each area may be a square, triangular or other area comprised of three or more mystery number regions, three or more pair clue regions, and a central or square clue region. For this example, a square clue region with four mystery numbers and four pair clues will be used. Some embodiments may employ larger regions. The areas may be stored or maintained in a list or other structure of a memory or storage device. Embodiments may evaluate each area until all have been fully evaluated. Operation 702 depicts determining that all areas have or have not yet been fully evaluated. If all areas have been fully evaluated, the process may complete as depicted by operation 704. As used herein, "fully evaluated" means that no more evaluations can be performed, such as assigning values to mystery number regions, simplifications, additions and modifications of clue regions and their choices/candidate lists.

If all areas have not yet been fully evaluated, operation 703 may be performed to pick an area that has not yet been fully evaluated and then operation 706 may be performed to determine whether all clues within an area have been evaluated. If so, the process may continue to the next area. Otherwise operation 708 may be performed. Clues may be solved by a brute-force method or other method, accounting for groups of pairs and neighboring squares affecting a common mystery number. Embodiments may employ heuristic methods to improve search speed.

The mystery numbers associated with a clue may be solved by comparison with all clues in the same area sharing a mystery number with the clue. The clues and associated mystery number regions may be compared to the adjacent clues and associated mystery number regions in all directions, i.e. up, down, left, right, and diagonally adjacent. Candidate values for the mystery numbers may be eliminated based on the comparison. Clues and common mystery numbers in adjacent areas may also be considered. A candidate value might be eliminated, for example, when the use of the candidate value in one area would conflict with clues and/or values in or assigned in an adjacent area. A value may be assigned when all but one candidate value has been eliminated.

Operation 710 depicts assigning a value when there is only one possible candidate value for a mystery number region, based on pairs of clues associated with the mystery number region.

At operation 712, a new clue may be determined and added to the list of clues for the area. Added clues may comprise reductions or simplifications of existing clues, based at least in part on assigned mystery number regions or existing clues in the area or adjacent area. Added clues may also comprise new clues based at least in part on assigned mystery number regions. Embodiments may also add new clues to adjacent areas, so in operation 713, adjacent areas that are affected by any changes made in operations 708 and 710 are added to the list of unevaluated squares. In this manner, a list of unevaluated squares is maintained and can be iterated, as further explained below, until no more unevaluated squares exist. For example, if a clue is added based on adjacent clues to the a square (area) or valued are assigned to a mystery number, any area adjacent to that change will need to be re-evaluated and the changes propagated, until no further change is possible.

Central or square clues may be considered to produce new clues. Embodiments may derive a new clue for one side of the area based on an existing clue on another side and a clue associated with a central clue region. For example, if a left-hand side of an area has the clue ×12, and the central clue has ×60, a new clue ×5 may be added as a clue to the right hand side. Embodiments may add candidate values for the mystery number regions associated with the new clue.

After eliminating conflicting candidates and/or adding new clues, the next clue within the area may be evaluated, as depicted in FIG. 7 by the flow of control reverting to operation 706. If all clues in the area have been evaluated, the next area may be evaluated, as depicted by the flow of control reverting to operation 702. If all areas have been fully evaluated, the process may finish as depicted by operation 704.

Figure 8:
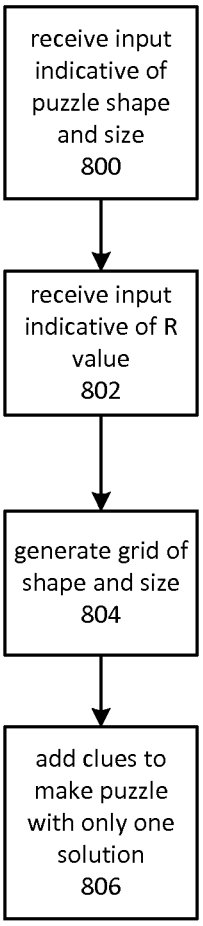
FIG. 8 is a flowchart depicting an embodiment of a process for generating puzzles having a single solution.

While embodiments for solving puzzles have been discussed, which presume the puzzle configuration already exists, and the mystery numbers are just being filled in based on zero or more clues and certain parameters, such as R=9 for a 3 by 4 puzzle configuration, FIG. 8 depicts an embodiment of a process for generating valid puzzle configurations having a single solution based on input parameters for the configuration and its difficult. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

A process for generating valid puzzles may be initiated by a user. The process may receive information indicative of puzzle parameters such as shape, size, and difficulty. As previously noted, the shape and size may be chosen from a list of existing shapes and sizes or generated because no puzzle of the same shape and/or size had been generated before. The shape and size may also be randomly generated by a random shape and size generator. This step is depicted by operation 800. The process may also receive indications of special puzzle variants, such as speed puzzles, repeating clue regions, no central clue regions, joker or wildcard regions, and so forth. At operation 802, information indicative of the puzzle's R value may be received. The R value may indicate the range of integral values permitted in a valid solution of the puzzle. In some embodiments, valid values may be integers in the range of 1 to R. In other embodiments, values may be in the ranges 0 to R, −R to R, and so on.

At operation 804, a grid of the designated shape and size may be generated. The grid may be initially empty of clues and mystery numbers. Embodiments may pre-fill certain squares, consistent with received parameters, with some number of joker or wildcard regions.

After the grid has been generated, sufficient clues may be added to the puzzle so that the puzzle has only one valid solution, as depicted by operation 806. Techniques and mechanisms for adding clues are described herein. Once sufficient clues have been added to ensure a unique solution, additional clues may be added to reduce the puzzle difficulty to a desired level.

Figure 9:
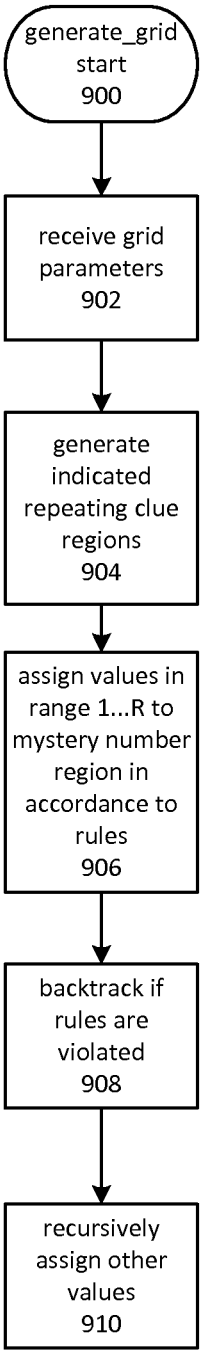
FIG. 9 is a flowchart depicting an embodiment of a process for generating a puzzle layout and associating mystery number regions in the puzzle layout with values.

FIG. 9 depicts a further procedure for generating a valid puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel. As indicated by operation 900, the procedure may be entitled "generate_grid." Those of ordinary skill in the art will appreciate that this designation is for descriptive purposes, and does not limit the intended scope of the disclosure. In addition, those of ordinary skill in the art will appreciate that the operations depicted in FIG. 9 may be embodied in various alternative combinations of circuitry and/or processor-executable instructions, including various approaches to modularity and encapsulation, such as alternative approaches to dividing functionality between various procedures or subroutines.

As depicted by operation 902, the embodiments may receive various parameters indicative of the puzzle to be generated, including a R value, an indicator that a repeating clue region should or should not be present, a quantity of joker or wild card regions, the size and shape of the grid, and so forth. Information indicative of the size and shape of the grid may comprise a number of rows and columns or other shapes and arrangements, a number of areas, a shape configuration of the areas, and so on. Embodiments may also receive information indicative of a pattern for the puzzle. The pattern may describe potential or required arrangements of pre-filled mystery numbers, joker or wildcard regions, clues, and so forth.

At operation 904, a repeating clue region may be generated for the puzzle, if the presence of such a region was indicated. A random area may be chosen and the repeating clue region generated for it. The central area depicted in FIG. 1 is an example of an area that might be chosen. The region can be generated by choosing a number in the valid range of numbers, such as 1 to R, and assigning that same number to three or more mystery number regions within the area.

Values for all remaining mystery number regions in the grid may be assigned, as depicted by operation 906. Embodiments may assign values in the range of valid numbers, such as 1 to R, to randomly selected mystery number regions in accordance with the rules of the puzzle. The rules checked may comprise ensuring that pairs of mystery numbers occur only once in a puzzle. If a number would violate a rule, another number may be selected. As depicted by operation 908, the process may backtrack if no new numbers in the valid range of numbers may be added without violating a rule. Operation 910 depicts recursively invoking a procedure for assigning values until a number has been assigned to all mystery number regions.

Figure 10:
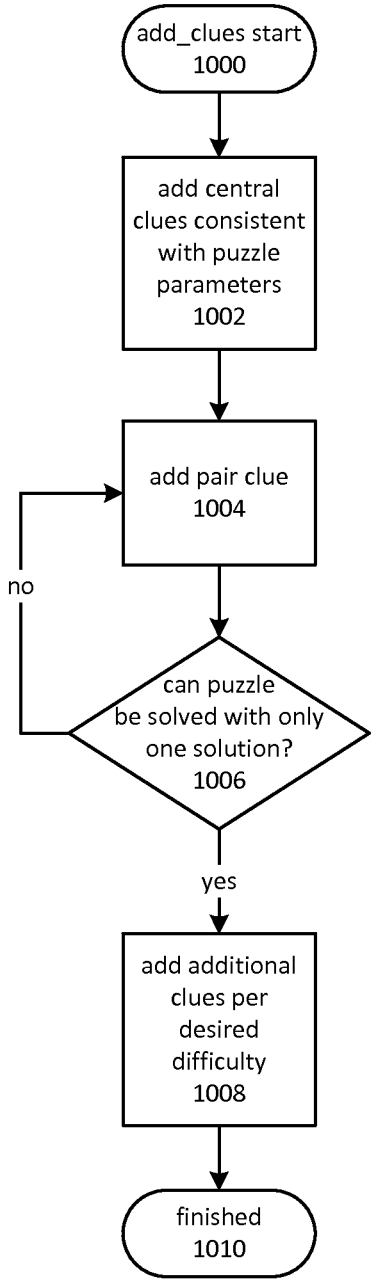
FIG. 10 is a flowchart depicting an embodiment of a process for adding clues to a puzzle to generate a puzzle of a desired difficulty and with only one solution.

Embodiments may assign clues to a puzzle after associating values with mystery number regions. FIG. 10 depicts an embodiment of a process for assigning clues to a puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel. As indicated by operation 900, the procedure may be entitled "add_clues." Those of ordinary skill in the art will appreciate that this designation is for descriptive purposes, and does not limit the intended scope of the disclosure. In addition, those of ordinary skill in the art will appreciate that the operations depicted in FIG. 10 may be embodied in various alternative combinations of circuitry and/or processor-executable instructions, including various approaches to modularity and encapsulation, such as alternative approaches to dividing functionality between various procedures or subroutines.

Embodiments may add central clues prior to adding pair clues. Operation 1002 depicts adding a number of central clues to central clue regions in a puzzle, consistent with puzzle parameters. The process may receive information indicating that the puzzle should contain a certain number of central clues, a maximum number of central clues, or a minimum number.

Operations 1004 and 1006 depict adding pair clues to the puzzle until the puzzle can be solved with only one solution. A pair clue may be selected for addition using various approaches such as those described herein. The puzzle may then be solved using the clues added up to that point. The solution attempt may result in zero, one, or more than one solution. If no solution is found, the process may backtrack to a previous point and try a different clue selection, then test the puzzle again. If more than one solution is found, additional clues may be added until only one solution is found.

The location and type of the clues added to a puzzle, including pair clues and central clues, may be based on various factors. Embodiments may select locations based in part on a pattern indicated as desirable for the puzzle, such as a symmetrical arrangement of clues or the asymmetrical configuration of the puzzle. The choice between plus clues and multiply clues or both clues may be based on the quality or difficulty of puzzle desired, as well as other factors, such as which choices most reduce the number of solutions to the puzzle or the number of partial solutions. As used herein, a "partial solution" is one where not all of the mystery number regions in the puzzle are assigned values using the clues in the puzzle and the heuristic part of the algorithm. The chosen operator type may influence whether the puzzle is more focused on logic skills or numeracy skills to solve, although all puzzles require numeracy skills.

Heuristics may also be employed to produce a minimal puzzle having a minimized number of clues. The following are examples of heuristics that may be used by various embodiments involving puzzles with rectangular central clue regions, although some heuristics would also be applicable to puzzles with central clue regions of other shapes and puzzles without central clue regions:

1) Choosing the pair clue region where the number of prime mystery numbers surrounding the pair clue (left, right, up, down), is smallest.
2) Choosing the pair clue region where the number of pair clue regions with clues surrounding the chosen pair is least.
3) Choosing the pair clue region furthest from existing clues in the puzzle.
4) Choosing a central clue region based on the value of that central clue region's multiply clue being the smallest compared to the central clues in other areas of the puzzle.
5) Choosing between a plus pair clue and a times pair clue based on the number of mystery numbers already determined. If the number of mystery numbers already determined is greater than the number of pair where no mystery numbers have been determined, chose a plus pair clue. Otherwise choose a times pair clue.
6) Choosing a repeating number region based on mystery number regions that may be assigned to it. Values where a corresponding multiply clue has fewer candidate choices for values may tend to produce easier puzzles, and values where the multiple clue has more choices may tend to produce more difficult puzzles.

Operation 1008 depicts adding additional clues to a puzzle that already has sufficient clues so that the puzzle has only one solution. The various techniques described above may be employed to select additional clues. Additional central clues and/or pair clues may be added. Once the puzzle has reached a desired difficulty level, the puzzle generation process may end, as depicted by operation 1010.

Embodiments may estimate the difficulty of a puzzle based on various factors, which apply to multiple central clue combinations for puzzles with repeating patterns of central regions. These include:

1) Mystery number values of 1 lead to much easier puzzles.
2) Clue combinations of 5, 7, 8, and 9 lead to multiply clues that have only one correct solution. Because the multiple value is large, these values lead to easier puzzles. Also, when used in repeating number regions, these numbers result in easier puzzles because there is only one solution for each multiply clue.

3) More generally, larger mystery numbers may produce more complex puzzles.
4) A central clue combination leading to a ×16 clue may be more difficult to solve, based on the number of permissible combinations of associated mystery number regions.
5) Clue combinations including 2, 3, 4, and 6 may lead to multiply clues having more than one solution, which may lead to harder puzzles.

The above factors also only apply to puzzles when R=9. When R=12 or R=15 or other values, the factors may be different.

Figure 11:
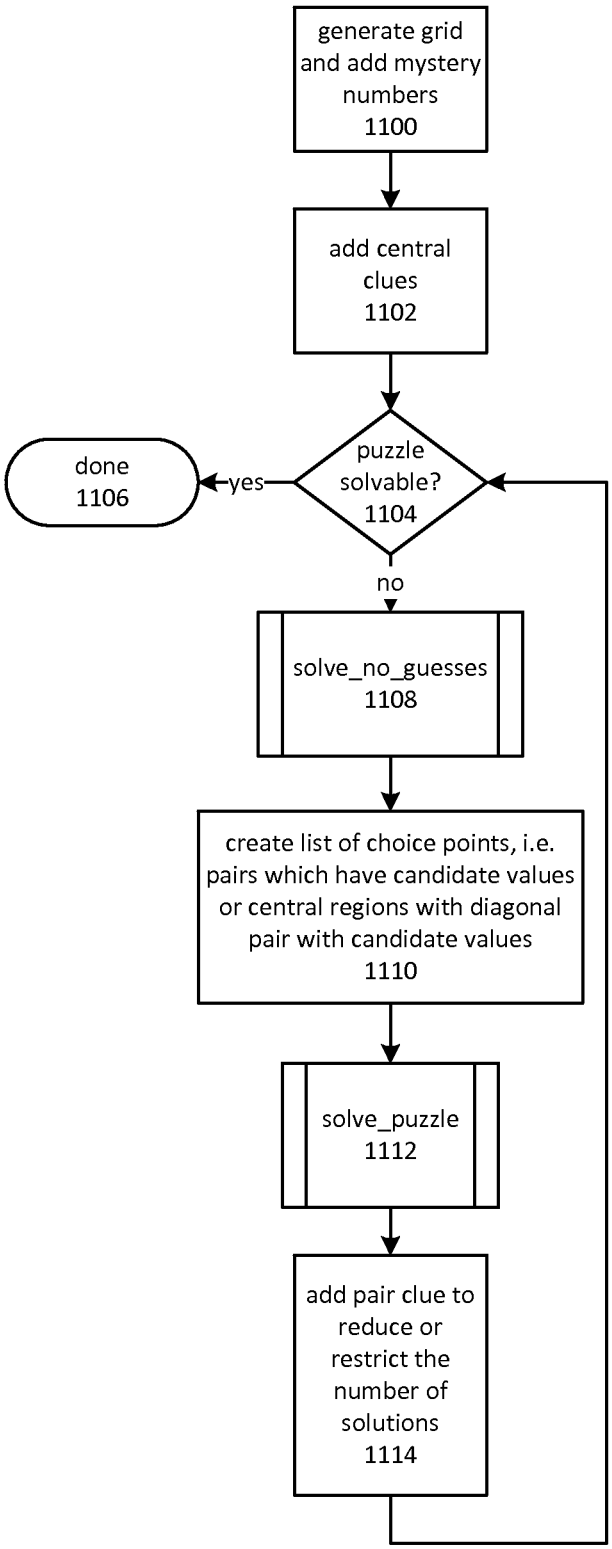
FIG. 11 is a flowchart depicting an embodiment of a process for adding clues to a puzzle while there is more than one possible solution to the puzzle.

FIG. 11 depicts an embodiment of a process for generating a puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

Operation 1100 depicts generating a grid of an indicated shape and size. For puzzles having central clue regions, the grid may comprise a number of partially overlapping central areas, where each area may consist of three or more mystery number regions, three or more pair clue regions, and a central clue region. An example of one area may be seen in FIG. 1A. Multiple areas may be joined in various combinations, such as puzzle configurations 1600, 1602, and 1604 in FIG. 16.

Embodiments may add mystery numbers to the grid using various approaches and mechanisms, such as those described herein. At operation 1102, central clues may be added to one or more areas within the puzzle.

Operation 1104 depicts determining whether or not the puzzle is solvable, i.e. resolves to one solution only. If so, the generation may be considered complete, as depicted by operation 1106, although additional steps may be taken by some embodiments to decrease the difficulty of the generated puzzle.

Operation 1108, which may be combined with operation 1104, depicts attempting to solve the puzzle without guessing. A process such as the one depicted by FIG. 7 may be used to solve the puzzle without making guesses.

Embodiments may create a list of choice points, as depicted by operation 1110. Choice points may comprise pair clues which have candidate values, as well as central clues having diagonally opposed candidate values. The list of choice points may be retained for use in performing a search of possible puzzles. For example, a depth-first search of possible puzzles may be performed, using the list of choice points to restore state as necessary to continue searching.

Operation 1112 depicts solving the puzzle, which may be performed using a process such as the one depicted by FIGS. 6A and 6B. The result of solving the puzzle may involve one solution, no solutions possible, multiple solutions, or multiple partial solutions. If no solutions are possible, backtracking may be employed. If only one solution is possible, the puzzle may be considered complete, subject to adjustment to reduce the difficulty of the puzzle. If multiple solutions are possible, additional pair clues may be added to reduce or restrict the number of possible solutions, as depicted by operation 1114. After an additional pair clue has been added, the process may repeat beginning at operation 1104.

Figure 12:
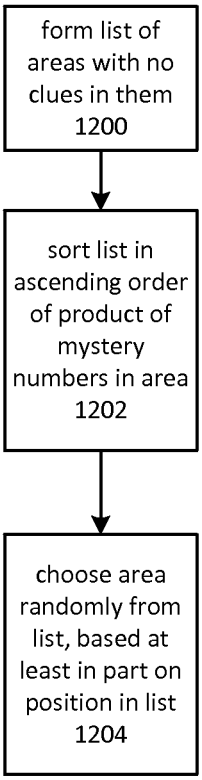

FIG. 12 depicts an embodiment of a process for adding central clues to a puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

At operation 1200, embodiments may form a list of areas, within a puzzle, that have no clues within them. The areas may comprise squares of the type depicted in FIG. 1A. The list may be sorted in ascending order of the product of mystery numbers already assigned to the area, as depicted by operation 1202.

Operation 1204 depicts choosing an area from the list, based at least in part on the areas position in the list. Based on the parameters supplied by a user, a given puzzle may be required to have an indicated number of central clues. Where this number is less than or equal to half of the number of areas in the list, embodiments may randomly select an area from the first half of the sorted list. Otherwise clues may be chosen from the list at random. Embodiments may employ other mechanisms, such as weighting probability of selection based on position in the list. Embodiments may also employ alternative mechanisms in lieu of forming a sorted list, such as searching an unsorted list, employing associative arrays, and so on.

Figure 13:
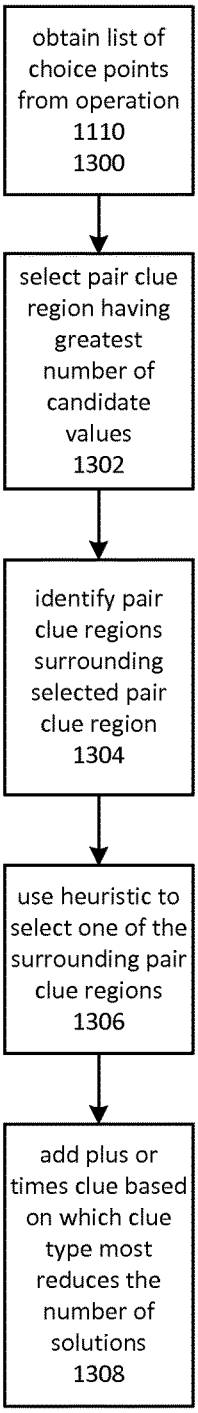
FIG. 13 is a flowchart depicting an embodiment of a process for choosing types and locations of pair clues.

FIG. 13 depicts an embodiment of adding pair clues to a puzzle. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

At operation 1300, embodiments may assemble a list of pair clue regions, each entry in the list having more than one candidate value. This operation may be performed during or subsequent to attempting to solve the puzzle using assigned clues without guessing.

Operation 1302 depicts selecting a pair clue region from this list based on which pair clue region has the greatest number of candidate values. A set of additional pair clue regions surrounding the selected pair clue region may then be identified, as depicted by operation 1304. Of these additional pair clue regions, a pair clue region may be selected to receive an additional plus or times clue. Embodiments may select, from the set of additional pair clue regions, using heuristics, the pair clue region having the least number of pair clue regions with clues around it. This is depicted by operation 1306. Embodiments may also base the selection, in whole or in part, on the pair clue region with the fewest prime mystery numbers around it. Various other heuristics may be employed.

Operation 1308 depicts adding a plus or times clue to the pair clue region selected from the set of additional pair clue regions. Embodiments may determine to add a plus clue or a times clue based on which clue provides the greatest reduction in the number of solutions. Embodiments may perform solution attempts to determine whether the plus or times clue is most effective at reducing the number of possible solutions.

Figure 14:
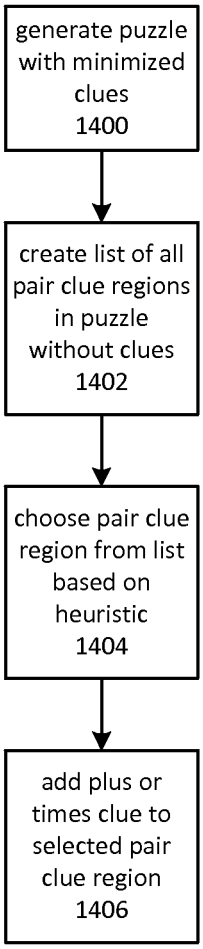
FIG. 14 is a flowchart depicting an embodiment of a process for adding clues to a puzzle already restricted to one solution.

FIG. 14 depicts an embodiment of a process for generating non-minimal puzzles, or in other words puzzles with more clues than is necessary to ensure that the puzzle has only one solution. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

Operation 1400 depicts generating a puzzle that has a minimized number of clues. Embodiments may generate a list of pair clue regions in the puzzle that do not yet have associated clues, as depicted by operation 1402. From this list, heuristics may be used to select a pair clue region from the list, as depicted by operation 1404.

Embodiments may employ various heuristic or algorithmic approaches to choose a pair clue region from the list. One approach is to randomly select an element. Another approach is to choose a region based on its impact on the difficulty level of the puzzle. Embodiments may prefer to select a region where its impact on the difficulty level of the puzzle will be as small as possible. This approach may allow for generating puzzles with a wide variety of difficulty levels.

A pair clue region may be chosen based on the chosen region having a least number of clues around that pair. For each region in the list, embodiments may calculate a weight to indicate how many clues are around the pair, possibly adjusted for the significance of the clues. Once a weight is calculated for each, the least weighted value may be selected. This approach may be employed by embodiments to select a region which, if a clue is added to it, would have the least impact on the difficulty of the puzzle. Embodiments may employ the opposite approach, selecting the highest weighted region, to create easy puzzles with a minimum number of clues.

A weight function may be based on examining each pair clue region around the region whose weight is being calculated. For each region having a clue, weight may be increased by a constant value. For each area above, below, left, or right of the area in which the region is located, the weight may be increased by a second constant value. For each area diagonally opposed to the area in which the region is located, the weight may be increased by a third constant value.

Figure 15:
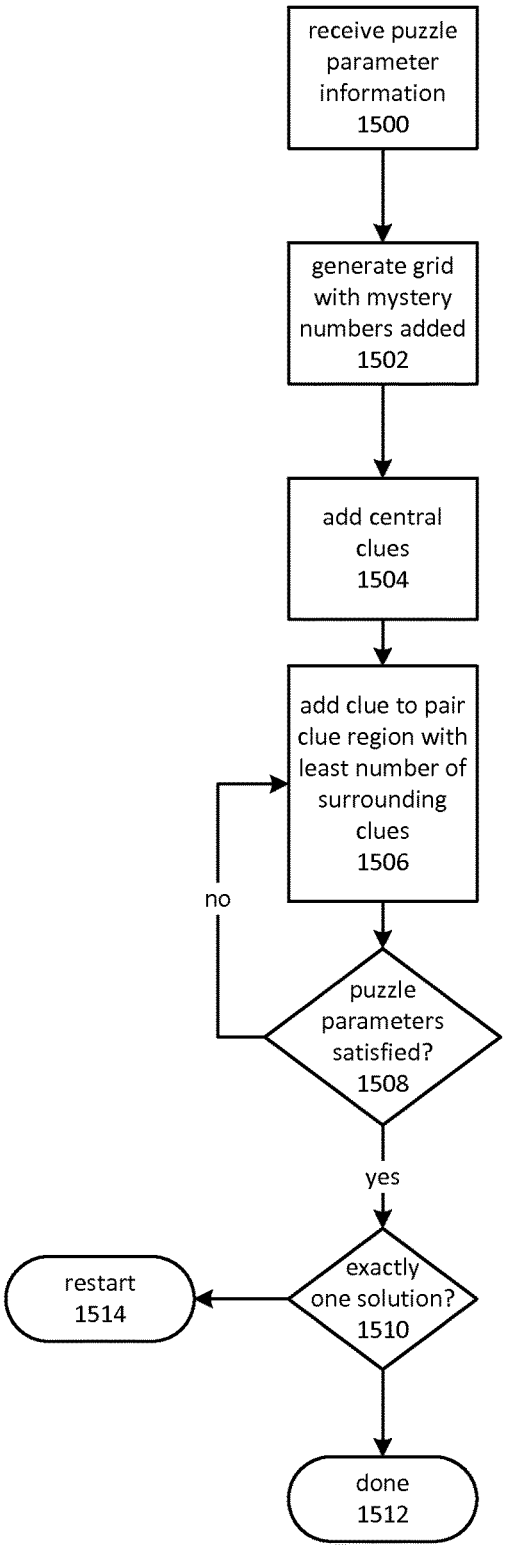
FIG. 15 is a flowchart depicting an embodiment of a process for generating puzzles having specified percentages of clues and clue types.

An alternative form of puzzle may be generated to have a large number of clues and therefore be quick to solve, which may be referred to herein as a speed type puzzle or speed puzzle, but which could be known by other names as well. FIG. 15 depicts an embodiment of a process for generating speed puzzles with a large number of clues. Although depicted as a sequence of operations, those of ordinary skill in the art will appreciate that the depicted operations are intended to be illustrative and not as limiting the intended scope of the disclosure, and that the depicted operations may be altered, omitted, reordered, or performed in parallel.

A process for generating a speed puzzle may receive parameters describing the puzzle, including various factors such as the size and shape of the puzzle, the intended difficulty, and so forth. The parameters may include a percentage value or other indicator of the number of pair clues the puzzle should have relative to the number of pair clue regions. A desired number of central clues may also be provided, which in some embodiments may typically be one or two central regions. Operation 1500 depicts receiving puzzle parameter information.

At operation 1502, a grid may be generated according to the specified parameters, and filled with mystery numbers for the purpose of generating clues. A desired number of central clues may then be added, as depicted by operation 1504.

Operation 1506 depicts adding a pair clue to a pair clue region in the puzzle. The clue may be added to a pair clue region having the least number of horizontally, vertically, and diagonally surrounding clues. Embodiments may employ this approach to minimize clustering of clues around a particular area of the puzzle. The added clue may be a plus clue and/or a times clue. Embodiments may randomly select the clue type, based in part on the specified parameters of the puzzle.

At operation 1508, it may be determined that the number of added clues satisfies the specified parameters of the puzzle. If the parameters have not been satisfied, additional pair clues may be added. If the parameters have been satisfied, operation 1510 may be performed to determine if there is exactly one solution to the puzzle. If there is only one solution, the process may end, as depicted by operation 1512. If there is more than one solution, the process may be restarted, as indicated by operation 1514. Some embodiments may restart at a stage following grid generation and mystery number assignment. Other embodiments may restart at earlier or later stages, or employ backtracking.

In an embodiment, speed type puzzles may also be generated in the manner described above with respect to generally generating puzzles such at that after operation 1502, a grid is generated with the right number of central clues and then the parameters are evaluated to determine if they have been satisfied. If the puzzle parameters have not been met, pair clues are then iteratively added as in operation 1508. The remainder of FIG. 15 would be the same, except there is no need to check for one solution in operation 1510, as this operation is performed during the process of generally generating puzzles.

Figure 16:
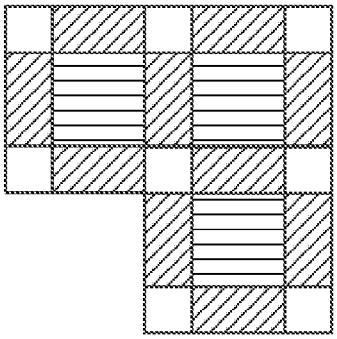
FIG. 16 is a block diagram depicting various non-limiting example embodiments of puzzle configurations.
Figure 16:
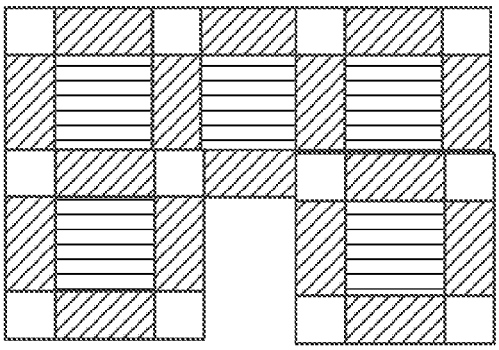
Figure 16:
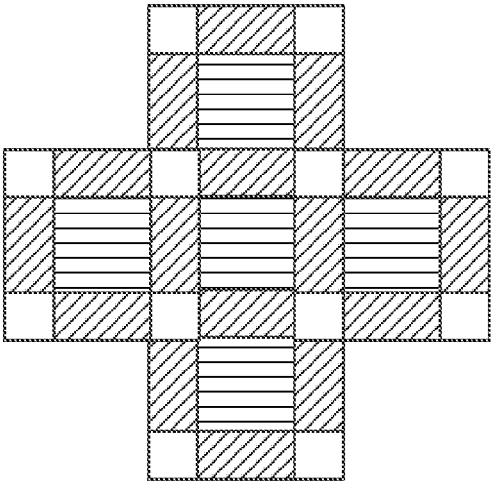

FIG. 16 depicts various non-limiting examples of puzzle configurations, including configuration 1600 consisting of three central areas, 1602 consisting of five central areas, and 1604 consisting of an alternative configuration of five central areas.

Figure 17:
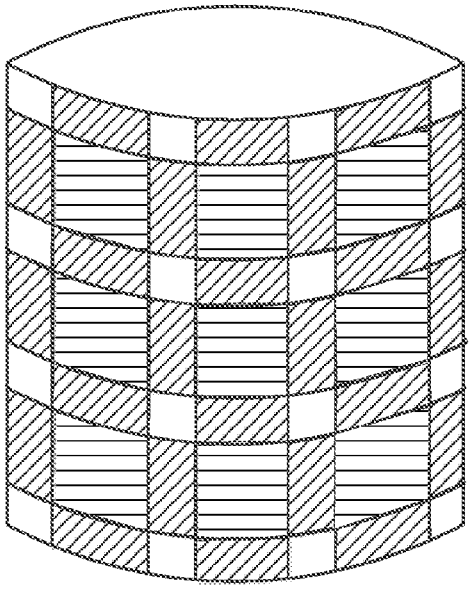
FIG. 17 depicts embodiments of puzzle configurations that have three-dimensional shapes.
Figure 17:
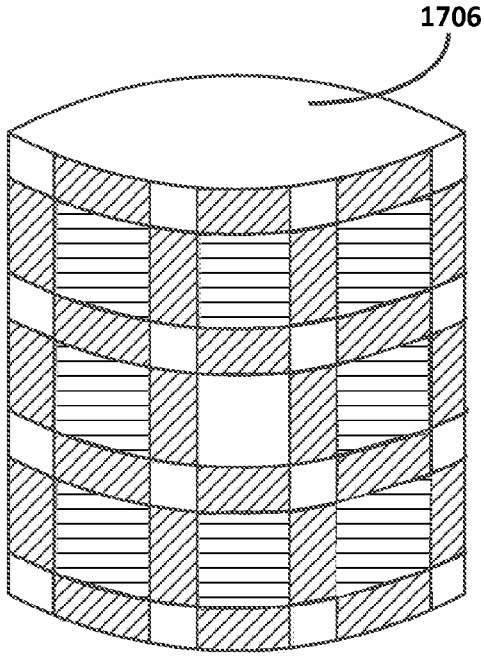

FIG. 17 depicts embodiments of puzzle configurations that have three-dimensional shapes, such as in puzzle 1702, and other configurations than those illustrated above. Puzzle 1702 is illustrated as being wrapped around a cylinder, but puzzle 1702 could be applied to and wrapped around other three-dimensional objects, such as squares, rectangles, polygons, spheres, etc. Holes or blanks can also be formed within puzzles where no data is present, either clues or mystery numbers, so as to further complicate the puzzles and make them more interesting. Puzzle 1704 shows is wrapped around a cylinder that has a hole 1706 formed through a central area of the cylinder 1706. Similar holes or blanks could be formed in other types of puzzles, whether two- or three-dimensional. Although square-shaped puzzle configurations are depicted, other shaped puzzles may be better suited for wrapping certain three-dimensional objects.

The embodiments of FIG. 17 also depict that puzzles may be formed into objects other than printed puzzles in books, magazines or newspapers or puzzles generated on the screens of computing devices. For example, the puzzles 1702 and 1704 may be individual products formed with puzzle designs wrapped around a hollow or solid cylinder that may or may not include clues and/or mystery numbers pre-filled in some of the clue and number regions. For example, the cylinders may be provided with just the pattern and users may be provided with access to a set of starting puzzle data (i.e., a clue or clues and a mystery number or mystery numbers that would result in a solvable puzzle) that may be added to the puzzle design using an erasable pen or pencil, thereby allowing the puzzle design to be used over and over to solve new and different puzzles with different starting puzzle data sets. In embodiments, the products could be manufactured with a starting puzzle data set that is unique to each product, or only repeated n times out of 1,000 products, etc. Users may then attempt to solve the partially completed puzzle.

Figure 18:
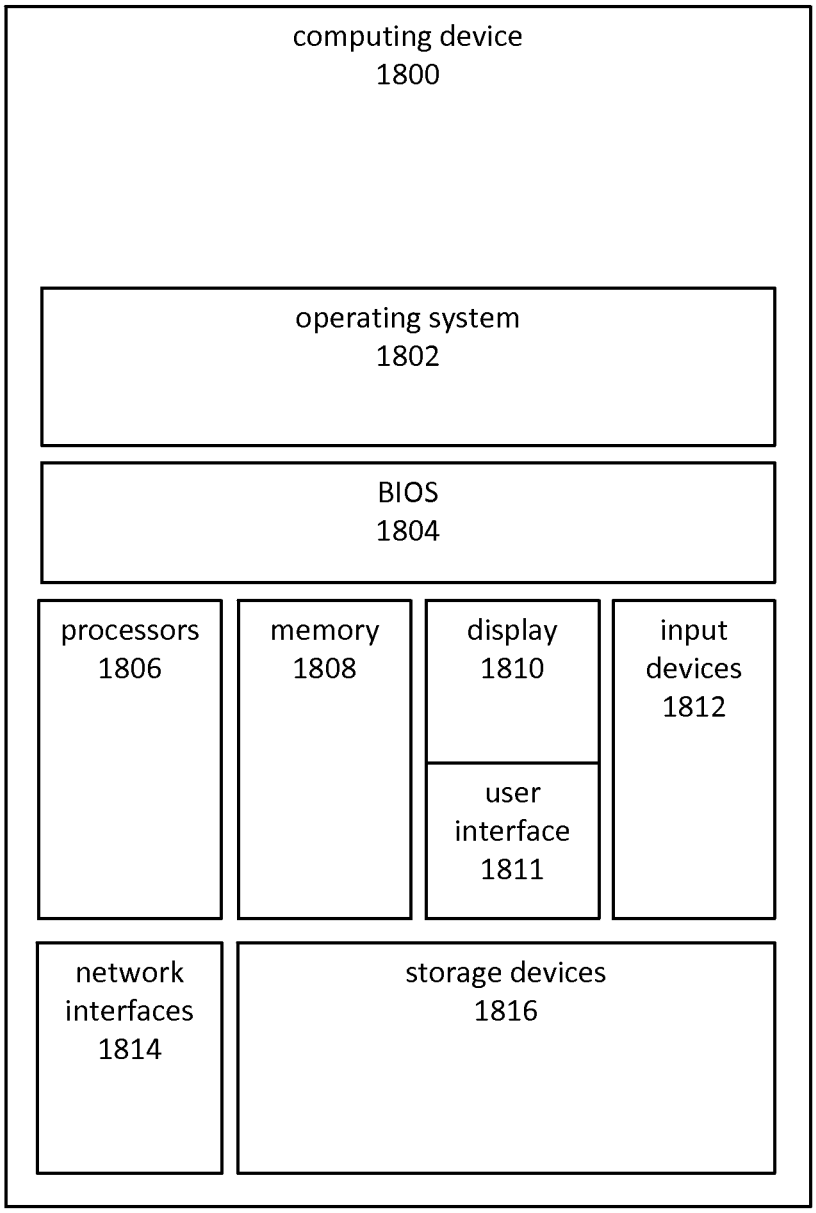
FIG. 18 is a block diagram depicting a non-limiting example of an embodiment of a computing device on which aspects of the present disclosure may be practiced.

FIG. 18 depicts an embodiment of an exemplary implementation of a computing device 1800 suitable for practicing aspects of the present disclosure. Computing device 1800 may be configured to perform various functions described herein by executing instructions stored on memory 1808 and/or storage device 1816. Various examples of computing devices include personal computers, cellular telephones, smartphones, tables, workstations, servers, and so forth. Embodiments of the invention may also be practiced on distributed computing systems comprising multiple computing devices communicatively coupled via a communications network.

One or more processors 1806 includes any suitable programmable circuits including one or more systems and microcontrollers, microprocessors, reduced instruction set circuits (RISC), application specific integrated circuits (ASIC), programmable logic circuits (PLC), field programmable gate arrays (FPGA), and any other circuit capable of executing the functions described herein. The above example embodiments are not intended to limit in any way the definition and/or meaning of the term "processor."

Memory 1808 and storage devices 1816 include non-transitory computer readable storage mediums such as, without limitation but excluding signals per se, random access memory (RAM), flash memory, a hard disk drive, a solid state drive, a diskette, a flash drive, a compact disc, a digital video disc, and/or any suitable memory. In the exemplary implementation, memory 1808 and storage device 1816 may include data and/or instructions embodying aspects of the disclosure that are executable by processors 1806 (e.g., processor 1806 may be programmed by the instructions) to enable processors 1806 to perform the functions described herein. Additionally, memory 1808 and storage devices 1816 may comprise an operation system 1802, basic input-output system ("BIOS") 1804, and various applications.

Display 1810 includes at least one output component for presenting information to a user of the computing device and may incorporate a user interface 1811 for providing interactivity through the display 1810. Display 1810 may be any component capable of conveying information to a user of the computing device. In some implementations, display 1810 includes an output adapter such as a video adapter and/or an audio adapter or the like. An output adapter is operatively coupled to processor 1806 and is configured to be operatively coupled to an output device such as a display device (e.g., a liquid crystal display (LCD), organic light emitting diode (OLED) display, cathode ray tube (CRT), "electronic ink" display, or the like) or an audio output device (e.g., a speaker, headphones, or the like).

Input Devices 1812 includes at least one input component for receiving input from a user. Input component 1812 may include, for example, a keyboard, a pointing device, a mouse, a stylus, a touch sensitive panel (e.g., a touch pad or a touch screen incorporated into the display 1810), a gyroscope, an accelerometer, a position detector, an audio input device, or the like. A single component such as a touch screen may function as both an input device 1812 and a display 1810.

Network interfaces 1814 may comprise one or more devices configured to transmit and receive control signals and data signals over wired or wireless networks. In various embodiments, one or more of network interfaces 1814 may transmit in a radio frequency spectrum and operate using a time-division multiple access ("TDMA") communication protocol, wideband code division multiple access ("W-CDMA"), and so forth. In various embodiments, network interfaces 1814 may transmit and receive data and control signals over wired or wireless networks using Ethernet, 802.11, internet protocol ("IP") transmission, and so forth. Wired or wireless networks may comprise various network components such as gateways, switches, hubs, routers, firewalls, proxies, and so forth.

An embodiment of a software implementation of the present disclosure, an application or app, will now be described. The application operates in conjunction with an operating system, such as operating system 1802, of a computer device 1800, to generate a user interface 1811 via the display 1810 that displays one or more interactive puzzles, as disclosed herein, to be solved by a user in a number of different modes. The user interface 1811 also provides various tools, scores and other items to assist, educate and entertain the user. While the application is described in the context of a software application, the puzzles described herein can be generated and solved in other ways, where puzzles may printed on paper or other tangible surfaces, generated on three-dimensional objects, as noted above, generated on websites, and may other embodiments. The application may operate on any computing device, such as computing device 1800, but is particularly well suited for a smart phone type of computing device.

Figure 19:
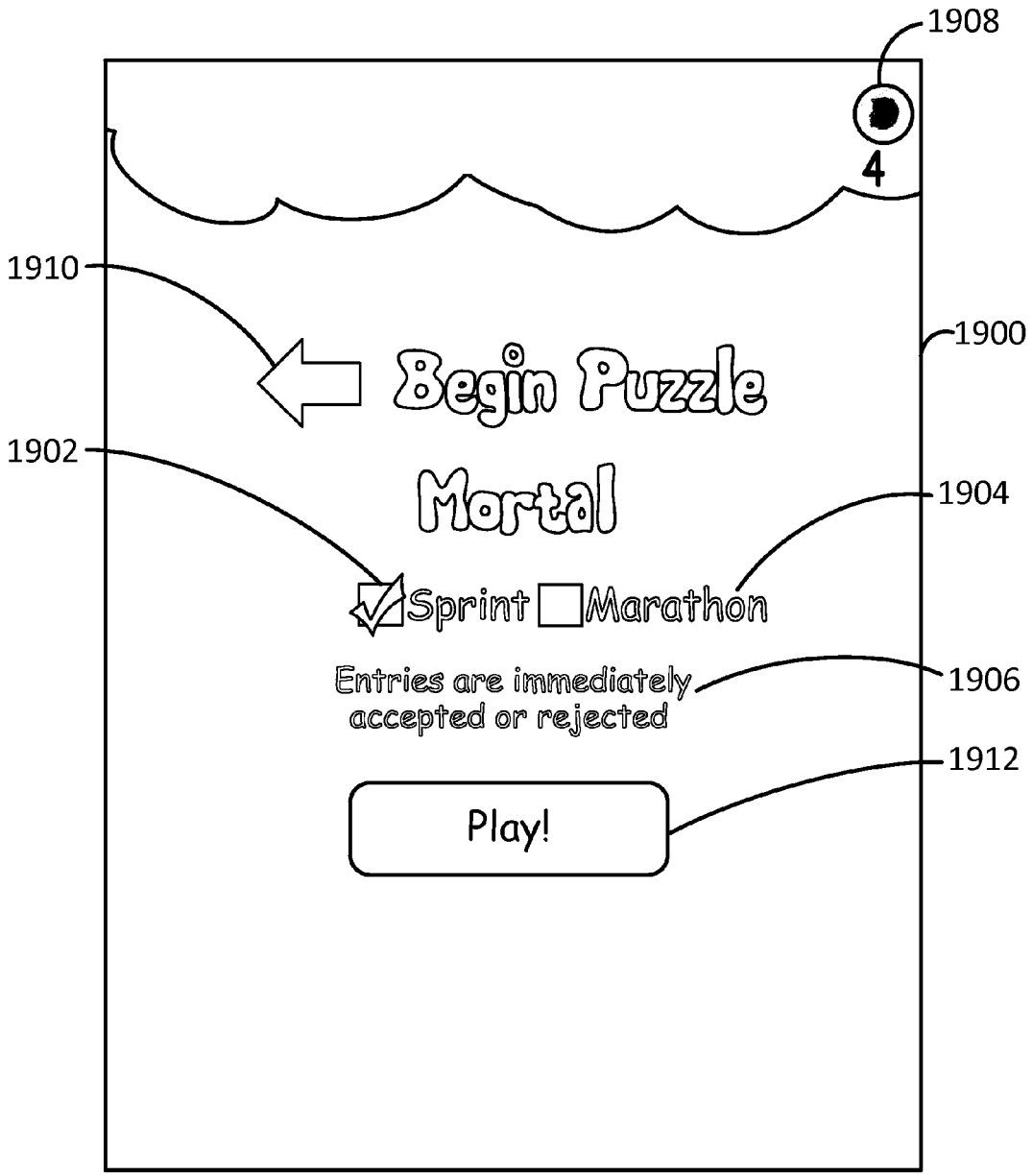
FIG. 19 is an illustration of a start-up screen generated by a user interface of a puzzle application in accordance with an embodiment.

After starting the application and proceeding through a number of start-up screens generated by the user interface 1811 of the application, a user will be presented with screen 1900 of FIG. 19, which presents the user with one or more game modes, such as sprint mode 1902 or marathon mode 1904. In sprint mode, the user interface immediately accepts or denies an entry made by a user for a value to be entered in a mystery number region. In addition, as further explained below, when the key pad pencil is turned on, entries made by the user are treated as notes until they are submitted by the user. As shown in FIG. 19, the user has selected sprint mode so an instruction 1906 indicates that entries are immediately accepted or rejected, which is consistent with sprint mode. In marathon mode, the user interface requires the user to fill in all mystery number regions in the puzzle with values before any such entries are accepted or rejected. All entries, however, until a final submission is indicated, are treated as notes and can be cleared, changed, etc., when the submitted answers are deemed to be incorrect.

FIG. 19 also shows a coin 1908 that indicates the number of credits that the user currently has earned and available for continued play. When the coin 1908 is lightly colored, the user may click on the coin 1908 and access a screen for buying additional credits. When the coin 1908 is darkly colored, it just indicates total credits. Credits may be earned when the application is installed or downloaded, for solving puzzles and performing other actions. As indicated, credits may also be purchased or possibly obtained from other sources. The arrow 1910, or some other icon, allows the user to go back to a previous page or to pause the game during use. Once the user is ready to start a puzzle, the user selects the play button 1912.

Figure 20:
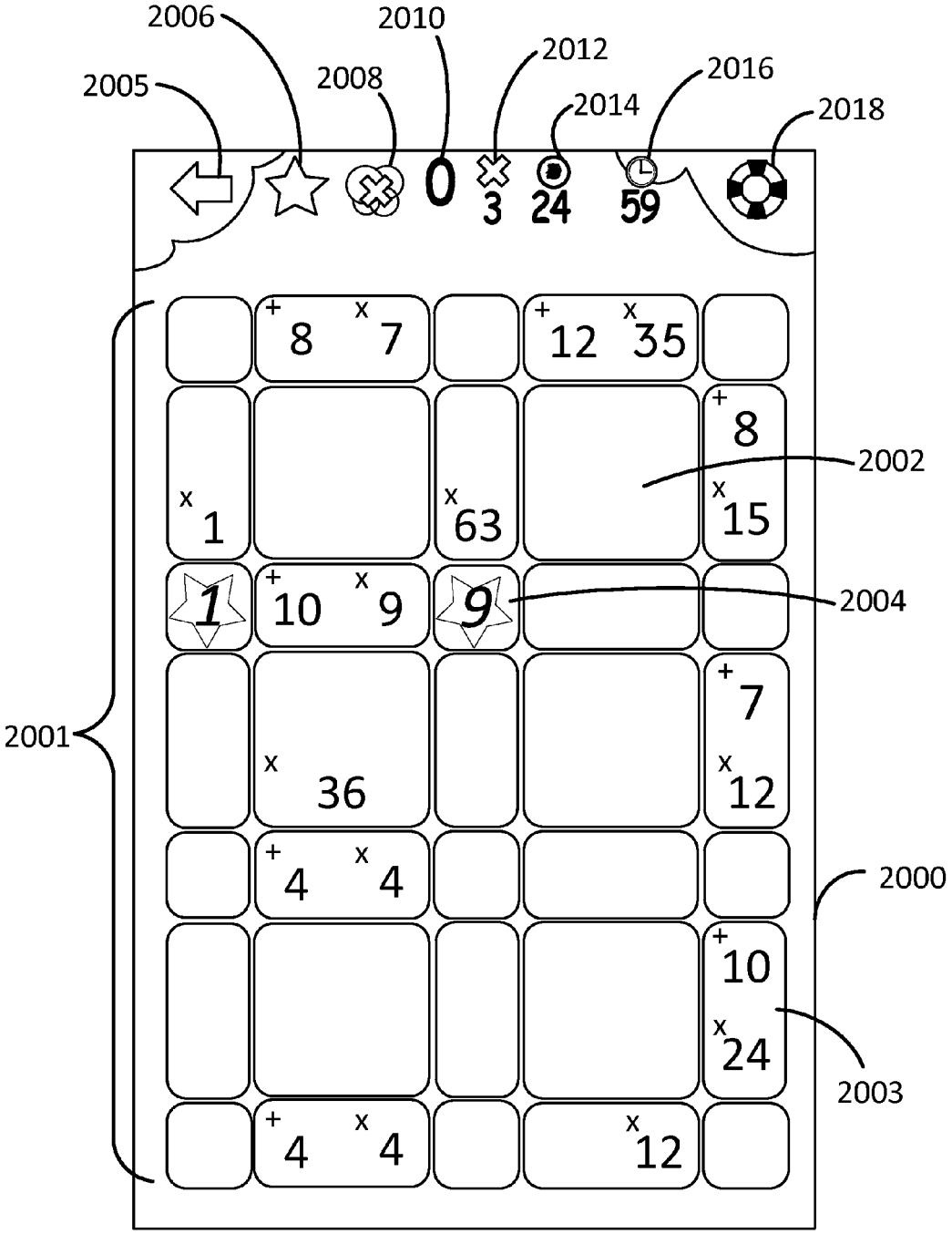
FIG. 20 illustrates a screen generated by a user interface of a puzzle application operating in sprint mode in accordance with an embodiment.

FIG. 20 illustrates a screen 2000 of a puzzle 2001 that is operating in sprint mode. The puzzle 2001 may be generated in real-time by the application, downloaded from a puzzle server (not shown) in communication with device 1800 through the network interfaces 1814, or from a store of puzzles stored within the storage devices 1816. The puzzle 2001 consists of 6 central clue regions 2002, 14 pair clue regions 2003, and 12 mystery number regions 2004, two of which have been correctly filled with values, as indicated by the star icons within two of the mystery number regions 2004. One of the central clue regions 2002 includes a multiply clue, while a number of the pair clue regions 2003 include plus clues and multiply clues. Obviously, puzzle 2001 is just an example and many other combinations of mystery numbers and clues may be shown in the puzzle configuration shown or in other puzzle configurations.

The icons above the puzzle provide the user with information about the status of the puzzle 2001 as well as other information. For example, the arrow 2005, performs the same function as arrow 1910 of FIG. 19. The star 2006 indicates the level of the puzzle within a number of possible difficulty levels and if selected will provide the user with information about the current level and whether the user is in marathon mode of sprint mode. The degree of difficulty of a puzzle is defined by the complexity of the puzzle, which is a positive integer calculated on a linear scale so the higher the complexity of the puzzle, the harder the puzzle is to solve. Puzzles can be categorized into N levels or categories, from easiest to hardest. While the present application has five levels of difficulty, corresponding to the difficulty of the puzzles on each level, that increase in difficulty as the user progresses through prior easier levels, there is no limit to the number of possible levels. A single star 2006 indicates that the user is at the first level; subsequent numbers of stars would indicate higher levels. The APPLE GAME CENTER logo 2008 indicates that the present application is operating on the APPLE IOS platform and indicates whether the user is currently logged in. Selecting the logo 2008 would enable the user to log in to the APPLE GAME CENTER. The "X" illustrated over the logo 2008 indicates that the user is not currently logged in. If the application was running on a different operating system platform, a different symbol may be indicated here that would provide the user with different information or different functions. The number 2010 indicates the number of points the user has so far earned using the current puzzle. As will be discussed below, certain actions by the user can result in the user being awarded points that then results in the number 2010 being incremented, or decremented, as appropriate. In the marathon mode the numbers of points appear only after the completion. The reason for this is not to give the user clues, by showing the increase or decrease of the points.

The error symbol 2012 indicates whether the user has any errors available for use. An error occurs when a user submits values for one or more mystery number regions that are incorrect. In sprint mode, the user may have one or more permissible errors for individual mystery number regions before completing a puzzle, also called "cZuesing," while in marathon mode the user may have one or more permissible tries/attempts for completing the entire puzzle. As illustrated on screen 2000, the number associated with the error symbol 2012 indicates that the user has 3 possible errors to use for the puzzle 2001. At higher puzzle levels, there may be no possible errors, in which case the error symbol 2012 would be darkly colored and no number associated with the error symbol 2012. The lightly colored coin 2014 indicates the user has one or more credits available for use. The number associated with the coin 2014 indicates that the user has 24 credits. Pressing on the coin at any time allows the user to purchase more credits or obtain more credit coins in some other way, such as liking the application in FACEBOOK, or some similar type of activity. The timer 2016 provides a remaining period of time left for the user to solve the puzzle and still be awarded points for cZuesing the puzzle. If the timer 2016 reaches 0 before the user has solved the puzzle, the user can still work on the puzzle, but will no longer cZues the puzzle. The life preserver 2018 provides the user with access to a guide menu for help or other information. Selecting the life preserver 2018 pauses the timer 2016 and the application while the guide is in use.

Figure 21:
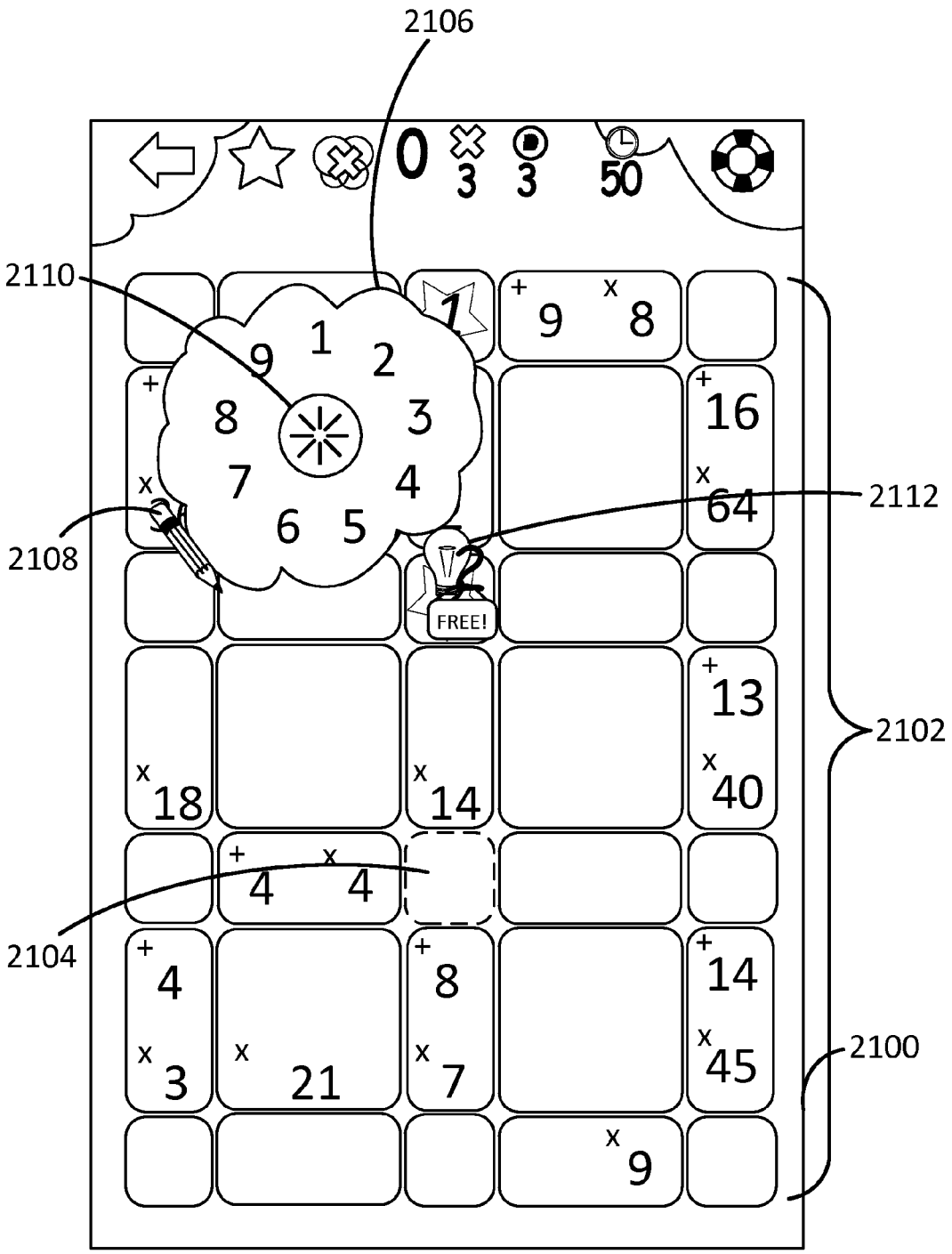
FIG. 21 illustrates screen and puzzle generated by a user interface of a puzzle application while in use.

FIG. 21 illustrates screen 2100 and puzzle 2102 while in use. When a user clicks on a mystery number region, also called "tiles" within the application, such as mystery number region or tile 2104, the tile 2104 will change to a contrasting color to indicate it has been selected and a movable keyboard or key pad dial 2106 may appear. The keyboard or key pad dial 2106 may include a ring of numbers for entering integers, such as the 1 to 9 illustrated in FIG. 21, a pencil 2108, a central button 2110 and a light bulb 2112. The user can move the key pad dial 2106 around the screen 2100 as desired or remove it from the screen 2100 by selecting the key pad dial 2106 and swiping it off the edge of the screen 2100. Being able to move the key pad dial 2106 may be important to being able to full use the puzzle 2102 and enable a faster solution to the puzzle. At any given time, the user may need to be able see any clues or mystery number regions or tiles 2104 in the puzzle in order to solve some portion of the puzzle, but if one or more tiles are hidden behind the key pad dial 2106, this may be difficult, which is why the key pad dial 2106 is movable or removable. User's playing on devices with keyboards attached may be able to enter numbers, take notes and otherwise use the puzzle without the key pad dial 2106. In sprint mode, when the key pad dial 2106 is visible, selecting one of the numbers from the ring of numbers will result in the value of the number being tried for the selected tile 2104. If the number is correct, the value of the number will be inserted in the tile 2104, but if incorrect, the number will not be inserted and the number will no longer be available for selection, so the user cannot make the same mistake twice. In marathon mode, the number ring can be used to insert numbers in different tiles, but no immediate indication is provided to the user as the user needs to attempt to solve the entire puzzle before one or more errors or success are indicated.

The central button 2110 serves different functions depending on the operational mode selected. In sprint mode, the central button 2110 is used for submitting note entries, as further described below. In marathon mode, the central button 2110 is used to confirm the submission of entries for the tiles, also as further described below. The light bulb 2112 may be used on some puzzles to receive hints or answers for particular tiles. Hints/answers may be possible for pair clue tiles, central clue tiles and mystery number tiles. The number associated with the light bulb 2112 indicates the number of free hints available, which may also be indicated by a banner or sign indicating free hints. Once the free hints have been utilized, additional hints may be available for purchase using coins or other means.

Figure 22:
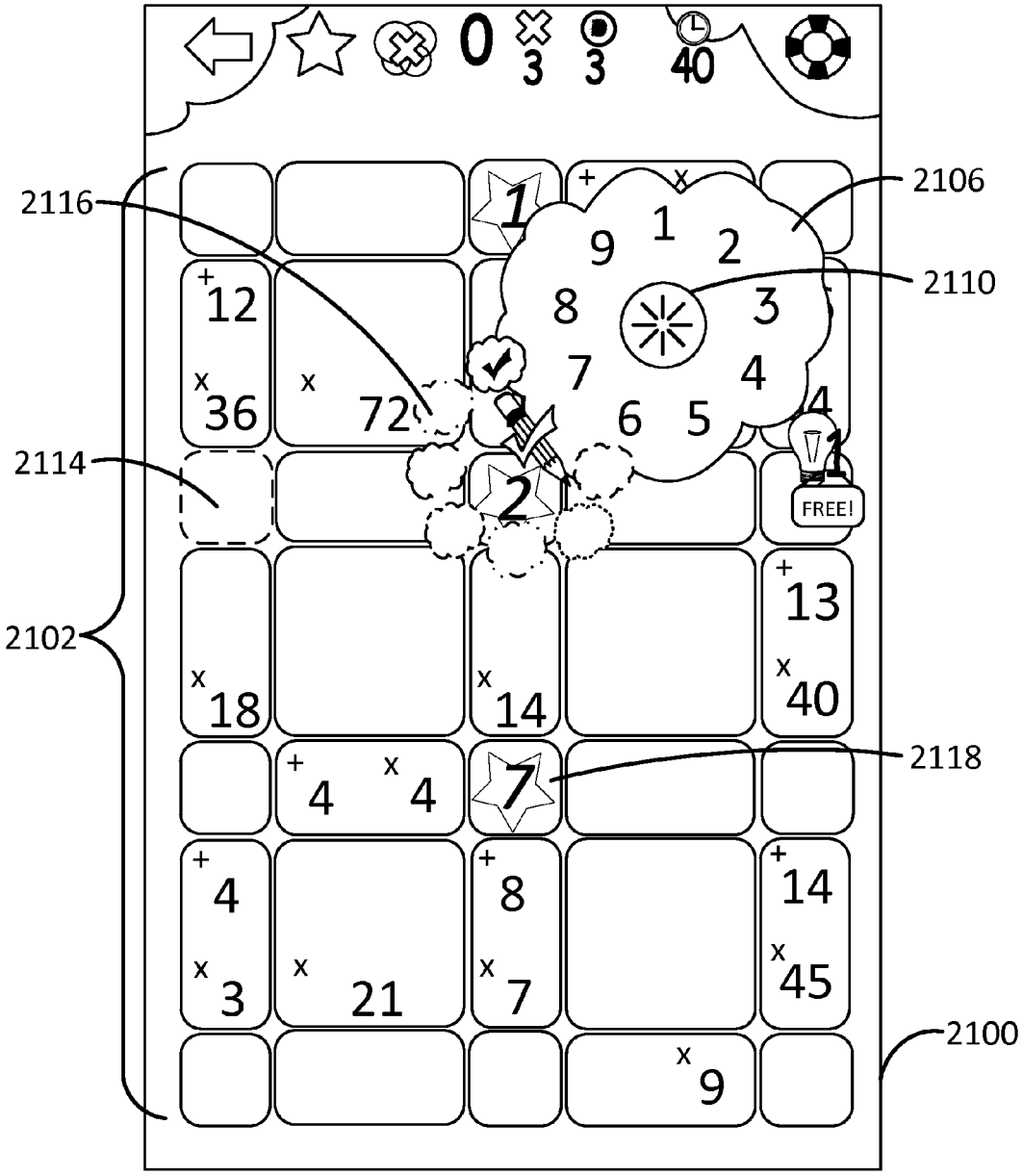
FIG. 22 is an illustration of a movable keyboard for entering values into the puzzle of FIG. 21 and note pads for taking notes on guesses for such values and clues.

As some puzzles may be more difficult to solve than others, the key pad dial 2106 also enables the user to make notes that indicate possible values for tiles without having to submit a number in sprint mode. For example, as illustrated in FIG. 22, by selecting the pencil 2108 (as illustrated in FIG. 21), numbers from the number ring can then be entered as notes and color (or otherwise) coded to distinguish different sets of notes from one another. For example, when using the key pad dial 2106 for taking notes on mystery number regions, when a user selects mystery number tile 2114, the key pad dial 2106 will appear. Selecting the pencil 2108 will cause a number of note pads 2116 to be displayed.

One of the note pads 2116 will be displayed with a check mark within the note pad while a check is also displayed over the pencil.

In an embodiment, the note pads 2116 each have a different color, the check mark within the selected note pad 2116 is black and color of the check mark over the pencil matches the color of the selected note pad. For example, if the note pad 2116 was gray, the check over the pencil would also be gray. Once the note pad was selected, a number from the number ring could be selected and that number would enter in the selected tile 2114 as a first guess at the value for that tile. That note or guess number would be smaller than the larger correct numbers, such as number 2118, indicated by stars within the puzzle 2102, and would be colored to match the colored note pad selected. In other embodiments, the note pads could all be the same color but have different shapes or hatching patterns to distinguish them from one another. In an embodiment, two numbers may be guessed for each selected note pad. When two numbers are selected for the same tile with the same note pad, both numbers would be illustrated within the tile 2114, but separated by a comma. In other embodiments, more than two numbers could be allowed to be selected for the same tile with the same note pad.

For example, as illustrated in FIG. 22, the value for tile 2114 could be a 6 given the pair clues of +12 and ×36, given that 6+6 equals 12 and 6×6=36. However, the user could temporarily think that the value of the tile 2114 may be an 8 or a 4 instead, given that 8+4=12. Once the user realizes that 8×4=32 and not 36, the user will realize the value for tile 2114 cannot be an 8 or 4, but using the note pads may be a way for the user to keep track of the user's guesses and give the user time to make sure of a guess before the value for that guess is submitted. Once a user has entered a guess using a note pad, a brush icon (not shown in FIG. 22, but shown in FIG. 23) will also appear around the key pad dial 2106, indicating that the number can be brushed away or erased. Selecting the brush would cause the guessed number(s) in the tile 2114 to be removed. If the puzzle is in sprint mode, once a number has been entered in a tile using the note pad, the central button 2110 may change color, indicating that if the user selects the central button 2110, the value submitted through the note pad will be entered as a number for the tile. If the number is accepted, the value will be illustrated in the manner of tile 2118, but if the number is rejected the number may disappear from the number ring of the key pad dial 2106, or be crossed off in some manner, and the number of permitted errors may be decremented. In marathon mode, the central button 2110 will not change colors indicating that the guessed numbers are ready for submission until values have been entered for all of the mystery number tiles, whilst each mystery number tile has only a single entry.

Figure 23:
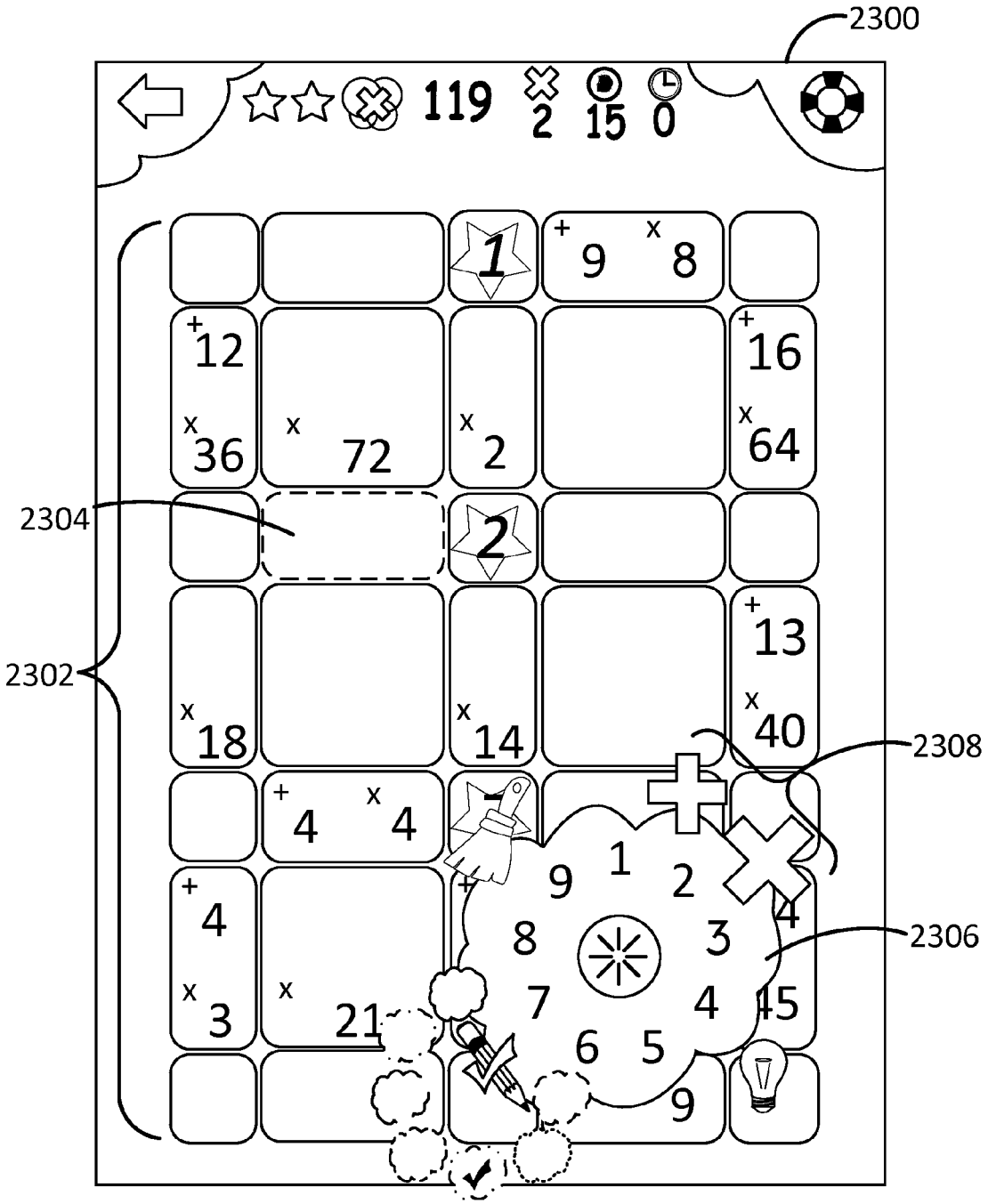
FIG. 23 is an illustration of a movable keyboard when used to resolve clues in accordance with an embodiment.

The key pad dial 2106 may also be used for guessing clues within pair clue regions and central clue regions. As illustrated in FIG. 23, when a clue region is selected, such as clue tile 2304 of puzzle 2302 of screen 2300, the clue tile will be highlighted and the key pad dial 2306 will appear with the addition of the plus and multiply symbols 2308. The key pad dial 2306 operates in substantially the same manner as the key pad dial 2106 when used for clues except that the user would first use the user interface to select a clue tile, such as tile 2304, and then select either the plus or multiply symbol 2308 from the key pad dial 2106. Once the plus/multiply symbol 2308 has been selected, the key pad dial 2106 would work in the manner previously described that enables uses to pick different note pads and number values to enter into the tile 2304 as plus or multiply clues. Notes on central clue tiles may be entered in a similar manner.

As previously noted, embodiments of puzzles may have various difficultly levels. Also, as previously noted, when a user solves a puzzle, the user is presented, through the user interface, with a score based on the user's performance on that puzzle and the complexity of the puzzle. For each puzzle, complexity may be calculated using a number of parameters, including:

- dimensions of the puzzle, as determined by M×N tiles and range R;
- the number of clues in a minimal puzzle; the higher the number of minimal clues, the easier the puzzle;
- the total number of clues (T) in the puzzle; the higher T, the easier the puzzle;
- the number of additional clues added to a minimal puzzle; the more additional clues added, the easier the puzzle;
- the number of guesses (g) that have to be made when solving a puzzle; the higher G, the harder the puzzle;
- the number of conflicts, as further described below; the higher the number of conflicts, classified into 5 bands from 1 to 5 and multiplied by a constant as noted below, the harder the puzzle;
- the number of mystery numbers revealed in the puzzle (e.g. in the lowest level puzzles, 2 mystery numbers are revealed for the user at the start of each puzzle);
- if a puzzle contains a repeating number region (called a "cZeus" below), and depending on the value of the repeating numbers, a suitable increment may be added to the complexity of a puzzle, but only if the user gets the correct solution within a pre-determined time from the time the user started to play the puzzle (e.g., for a 3 by 4 puzzle, R=9, a puzzle with a repeating number region of 2, 3, 4, and 6, will carry a higher increment in the complexity function; and
- the number of pair plus and multiply clues, and the number of central plus and multiply clues, as well as the ratio of pair clues and central (i.e., square) clues relative to the total number of clues.

Hence, various metrics are used to calculate the puzzle complexity, including:

- the ratio (SQ/T) of the total number of square clues (SQ) to the total number of clues (T); the higher this ratio, the harder the puzzle;
- the ratio (SQ+/SQ) of number of square plus clues (SQ+) to the total number of square clues (SQ); the higher this ratio, the easier the puzzle;
- the ratio (P/T) of total number of pair clues (P) to the total number of clues (T); the higher this ratio, the easier the puzzle;
- the ratio (P+/P) of pair plus clues (P+) to the total number of pair clues (P); the higher this ratio, the easier the puzzle; and
- the ratio (+/T) of total plus clues (+) in the puzzle to the total number of clues (T).

As noted above, while solving a puzzle, the user may be required to make guesses as to mystery numbers and possibly clues. Once one or more guesses have been made, the rest of the puzzle may be solvable. During this process, if the puzzle rules are violated, a 'conflict' is raised. When a conflict is raised, the guess is rejected and a new guess is made. As described above, the conflict number indicates how many times 'conflicts' are detected while solving the puzzle using the iterative and recursive approach described herein.

The puzzle complexity function, then calculates the complexity of a puzzle using the above parameters together with a set of scaling factors used in the formula. Once the puzzle complexity has been calculated, puzzles are categorized into categories (Level 1-5 or more) using the linear complexity band calculated above. The linear range of puzzle complexities go from a minimum to a maximum value. These minimum and maximum values vary depending on the values of M, N and R. This range is then divided into as many categories as required. In the embodiment of the application disclosed herein, for 3 by 4 puzzles, this range is divided into 5 categories.

The formula for calculating the complexity function for 3 by 4, Range=9 puzzles may be as follows, where the sum of (1) to (6) below equals the complexity of the puzzle:

(1): (G+1)*100, where 100 is a constant for 3 by 4 puzzles;

(2): #conflict category*80, where
- Category 1: #conflicts=0
- Category 2: #conflicts=1-3
- Category 3: #conflicts=4-10
- Category 4: #conflicts=11-50; and
- Category 5: #conflicts=101-more, and where 80 is a constant for 3 by 4 puzzles;

(3): +200, if the cZeus no=2, 3, 4, 6,
- +100, if cZeus no=7, 8, 9, and
- −100, if cZeus no=1, 5, where 100 and 200 are two constants for 3 by 4 puzzles;

(4): (14−no-of-minimal-clues)*50, where 14 and 50 are two constants for 3 by 4 puzzles;

(5): (6−no-of-additional clues)*50, where 6 and 50 are two constants for 3 by 4 puzzles; and (6): if SQ/T<0.4, then add SQ/T*50+P+/P*200+SQ+/SQ*50*(1+C*SQ+only/SQu)+(+/T)*80, but
- if 0.4<=SQ/T<=0.6, then add SQ/T*50+P+/P*80+SQ+/SQ*50*(1+C*SQ+only/SQu)+(+/T)*200, but
- if SQ/T>0.6, then add SQ/T*300+P+/P*100+SQ+/SQ*300*(1+C*SQ+only/SQu)+(+/T)*80, where C and the numbers 50, 80, 100, 200, 300 are constants chosen for 3 by 4 puzzles, C=2, and where:
- +/T is the ratio of total plus clues to total clues;
- SQ/T is the ratio of square clues;
- SQ+/SQ is the ratio of square plus clues to total square clues;
- P+/P is the ratio of pair plus clues to total pair clues; and
- SQ+only/SQu is the ratio of squares with only one plus clue to the number of squares with one or two clues.

The possible scores that can be obtained by a user of a puzzle depends on the complexity of the puzzle, as described above, and the user's performance. In sprint mode, as the user fills empty mystery number tiles with the correct answers, the user will be awarded a fixed number of points that is determined for each puzzle configuration. For example, for a 3 by 4 puzzle, Range=9, the fixed number is 2. If a puzzle contains a cZues square, i.e, a set of four repeating number regions forming a square or rectangle, and depending on the value of the repeating numbers of that square, and also depending on how long it takes the user to file in the three or more mystery numbers of the square with the corrects answers (from the start time of the puzzle), additional points may be added to the user's score for the puzzle. No points are awarded if any hints were provided to the user or if there were any errors associated with incorrect entries. The points awarded or a cZues square are called "cZeusSquarePoint." The value of cZeusSquarePoint is also based on the puzzle configuration. For example, for a 3 by 4 puzzle, Range=9, this value is 10.

As a user adds each of the correct values in each mystery number box, a Time Bonus point, called "TB" is added to the final score. The faster the user adds the correct value of a mystery number tile, the higher the TB for that mystery number tile. This time interval is calculated from the time the previous mystery number tile was filled by the correct value, till the time the latest mystery number tile is filled by the correct answer. This time interval is called "Time-Interval." TB is then calculated as a function of: total number of mystery numbers in a puzzle (called "total=m×n," where m and n are the dimensions of the puzzle.), the puzzle-complexity (as described above), and the Time-Interval.

If $C$=(Puzzle-Complexity×(1/total)×Constant-Factor)

Then $TB$=$C$/Time-Interval.

An appropriate "Constant-Factor" is also selected depending on values of m, n and R of the puzzle For each level of puzzles, the user is allowed a certain number of "Errors" while entering values into mystery number tiles. If this number of allowed "Errors" is reached, while the user continues to use the puzzle, the puzzle will not be deemed to be "cZeused." For instance, for level one puzzles, the number of Errors allowed is 3. A number of free Hints are provided for each level of the puzzles (for instance, for level one puzzles, 2 free Hints are given.) Subsequent hints will incur a charge from the user's coins. Regardless of the hints being free or purchased, using a hint will reduce the score of the user as follows:

I. No points are given for completing the Mystery number tile, if the hint was used directly to get the answer for that mystery number tile.

II. Half the mystery points "Mystery-no-point" are given per hint used for each pair-clue used which are related to that mystery number. The two mystery numbers of a pair are said to be related to that pair clue.

III. No Time Bonus or TB points are given for a mystery number answered with a direct hint.

IV. Half the TB points, as calculated above, are given per hint used for each related pair/square clue hint. The two mystery numbers of a pair are said to be related to that pair clue. The four repeating mystery numbers of a square are said to be related to that square clue.

V. Reduce the given "Puzzle-Complexity" by 5% (or some other amount) for calculating TB points for entries after the first hint. i.e. reduce Puzzle-Complexity after the first hint by multiplying it with (1−0.5) =0.95

VI. Reduce Puzzle-Complexity by compounding a reduction-factor of 5% (or some other amount) for any subsequent hints. For example, after the second hint, Puzzle-Complexity may be reduced to 0.95×0.95× Puzzle-Complexity.

In addition to the above, each time the user enters the incorrect value in a mystery number tile, the user is penalized by reducing its score by a fixed amount, a "Penalty-Point." For 3 by 4, Range 9 puzzles, Penalty-Point=2.

The final score of a sprint mode puzzle is then calculated as follows:

Add a1: Total entry of correct mystery number with no direct hints×Mystery-no-point;

Add a2: Total entry of correct Mystery number with no pair/square-hints×(Mystery-no-point/2);

If all mystery numbers of the puzzle are entered correctly with no direct hints or errors, then add a bonus equal to value of (a1+a2) as in above;

If the cZeus-Square is detected within the time specified limit specified with no hints and errors, add cZeusSquarePoint to the final score;

Add all time-based TB points earned; and

Subtract all penalties for mistakes made by the user.

In marathon mode, the scoring function differs slightly from the scoring for sprint mode. Regardless of the hints being free or purchased, using a hint will reduce the score of the user as follows.

I. No points are given for completing the mystery number tile if the hint was used directly to get the answer for that mystery number tile;

II. Every time a pair clue is revealed, the two corresponding mystery numbers of that clue will receive half of the Mystery-no-point;

III. Reduce the given Puzzle-Complexity by 5% (or some other amount) for calculating TB points for entries after the first hint, i.e. reduce Puzzle-Complexity after the first hint by multiplying it with (1−0.5)=0.95; and VI. Reduce Puzzle-Complexity by compounding a reduction-factor of 5% (or some other amount) for any subsequent hints. For instance, after the second hint, Puzzle-Complexity is reduced to 0.95×0.95×Puzzle-Complexity.

The time based score, TB, is calculated differently in marathon mode as well. "Total-Time-Interval" denotes the total time taken to solve the puzzle (at the end of the first, second, or third tries). TB is calculated as a function of: total number of mystery numbers in a puzzle (called "total=m×n," where m and n are the dimensions of the puzzle.), the puzzle-complexity (as described above), and the Total-Time-Interval.

Let D=Number of correct Mystery Numbers, directly or indirectly, unaffected by clues revealed+number of mystery numbers affected directly by pair hints×$0.5^{j1}$, where j1 is the number of pair hints used so far)+number of mystery numbers affected directly by square hints, excluding the mystery numbers affected by pair hints×$0.95^{j2}$, where j2 is the number of square hints used so far. The values 0.5 and 0.95 are two constants used for 3 by 4 puzzles.

The time based score, TB is calculated as follows:

$$TB=D\times C/t,$$

where t=Total-Time-Interval/total for puzzles, where no mystery numbers are revealed. and t=Total-Time-Interval/(total−2))) for Mortal puzzles, where two mystery numbers are revealed.

For 3 by 4 puzzles, total=3×4=12, and hence total−2=10.

The final score of a marathon mode puzzle is calculated as follows:

Add a1: Total entry of correct Mystery number with no direct hints Mystery-no-point;

Add a2: Total entry of correct Mystery number with one clue-hint×(Mystery-no-point)/2;

If in the first try, all mystery numbers of the puzzle were entered correctly with no direct hints, then add a bonus equal to value of 2×(a1+a2);

Only in the first try, if the cZeus-Square is detected within the time limit specified in the App, with no hints; add cZeus-Square point cZeusSquarePoint to the final score; and Add TB points calculated as above.

The various processes, methods, and algorithms described herein may be embodied in various combinations of general-purpose and application-specific circuitry. The processes, methods, and algorithms described herein may be embodied in whole or in part by code modules executed by one or more processors of a computing system. The code modules may be stored on any type of non-transitory computer-readable storage medium, such as magnetic disk drives, optical disk drives, solid-state memory, random-access memory, read-only memory and so forth. Some or all of the code modules may be transferred between various memories and storage devices for various purposes, such as memory management by a computer operating system. In various embodiments, processes, code modules, and other elements may be distributed among multiple computing systems communicating via a computer network or other communications method. The results of the various processes, methods, and algorithms described herein may be stored in any type of non-transitory computer storage including volatile and non-volatile memory.

Aspects of the embodiments described herein may be used independently of one another, or combined in a variety of ways. All possible combinations and sub-combinations are intended to fall within the scope of the present disclosure. Various blocks or elements depicted in the figures may be added, removed, rearranged, or reconnected in various ways to form alternative embodiments. The embodiments described herein have been provided as examples, and are not intended to limit the scope of the present disclosure. Nothing in the description provided is intended to imply that any particular feature, characteristic, operation, step, block, or other element is required.

Conditional language such as "can," "could," "may," "might," "for example," and so on is generally intended to convey that some embodiments include the recited element while other embodiments do not. Accordingly, unless specifically stated otherwise or required by context, such language is not intended to imply that the recited element is a mandatory component of any particular embodiment. The terms "comprising," "having," "including" and so forth do not exclude additional elements. When the term "or" is used to connect a list of elements, it is used inclusively to refer to one or more of the elements of the list.

What is claimed:

1. A computer-implemented method for solving a puzzle, the method comprising:

identifying, by the computer, a plurality of clues associated with a plurality of clue regions within first areas of a mathematical puzzle and a plurality of mystery number regions within second areas of the mathematical puzzle, wherein the first areas of the mathematical puzzle and the second areas of the mathematical puzzle are in separate locations, wherein the plurality of clue regions include either a pair clue region interposed between a pair of mystery number regions, a central clue region surrounded by three or more mystery number regions, or both the pair clue region and the central clue region, wherein each of the mystery number regions corresponds to a mystery number value with no limitation on an amount of times a single mystery number value between 1-R appears in the mathematical puzzle when the mathematical puzzle is solved except that a same pair of mystery number values corresponding to the pair of mystery number regions interposing any pair clue region can only appear once in the mathematical puzzle unless the pairs of mystery number regions interposing three or more pair clue regions also form the three or more mystery number regions surrounding a single central clue, in which case the same mystery number value is utilized for all mystery number regions among the pairs of mystery number regions, wherein R is a whole number within a range of whole number values, and wherein the mathematical puzzle can only have one solution when each mystery number value associated with each mystery number region among the plurality of mystery numbers regions are solved;

selecting, by the computer, a first clue region from the plurality of clues regions based at least in part on the clue region being associated with a pair of mystery number regions having a least number of potential number values; and assigning, by the computer, a pair of candidate number values to the pair of mystery number regions associated with the first clue region;

determining, by the computer, if the mathematical puzzle can be solved based on the assigned pair of candidate number values; and assigning candidate number values to a series of additional clue regions among the plurality of clue regions until the mathematical puzzle has been solved.

2. The method of claim 1, wherein assigning candidate number values further comprises:

selecting, by the computer, an area of the mathematical puzzle from the first areas based at least in part on the area not being fully solved;

selecting, by the computer, an additional clue region from the area; and assigning candidate number values to the mystery number regions associated with the additional clue region based at least in part on evaluating one or more additional clues regions associated with the mystery number regions.

3. The method of claim 2, wherein the additional clue region is a central clue region.

4. The method of claim 1, wherein the plurality of clue regions includes a plurality of central clue regions and a plurality of pairs of mystery number regions, wherein each of the central clue regions is square-shaped, and wherein each of the pairs of mystery number regions is situated along each side of the square-shaped central clue region and each pair of mystery number regions shares a single mystery number with an adjoining pair of mystery number regions.

5. The method of claim 1, wherein the pair of mystery number regions is horizontally, vertically or at any angle interposed by the pair clue region.

6. A system for generating puzzles, the system comprising:

a computing device comprising one or more processors communicatively coupled to one or more memories and a storage device, the computing device configured at least to:

receive information indicative of a mathematical puzzle configuration;

generate a puzzle layout conforming to the information indicative of the puzzle configuration, the puzzle layout including first areas of the puzzle including a plurality of clue regions and second areas of the puzzle including a plurality of mystery number regions, wherein the first areas of the puzzle and the second areas of the puzzle are in separate locations, wherein the plurality of clue regions include either a pair clue region interposed between a pair of mystery number regions, a central clue region surrounded by three or more mystery number regions, or both the pair clue region and the central clue region, wherein each of the mystery number regions corresponds to a mystery number value with no limitation on an amount of times a single mystery number value between 1-R appears in the puzzle when the puzzle is solved except that a same pair of mystery number values corresponding to the pair of mystery number regions interposing any pair clue region can only appear once in the puzzle unless the pairs of mystery number regions interposing three or more pair clue regions also form the three or more mystery number regions surrounding a single central clue, in which case the same mystery number value is utilized for all mystery number regions among the pairs of mystery number regions, wherein R is a whole number within a range of whole number values, wherein the puzzle can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, wherein the central clue region corresponds to a central times clue representing an arithmetic product of mystery number values of the mystery number regions surrounding the central clue region or a central plus clue representing an arithmetic sum of mystery number values of the mystery number regions surrounding the central clue regions, and wherein the puzzle layout is initially devoid of pair plus clues, pair times clues, central plus clues, central times clues, and mystery number values;

generate a set of hidden number values, each hidden number value associated with a mystery number region in the puzzle layout;

while the puzzle has more than one possible solution, add one or more pair plus clues, pair times clues, central plus clues, or central times clues to one or more selected pair clue regions to create a partial puzzle layout, the one or more pair plus clues, pair times clues, central plus clues, or central times clues conforming to the set of hidden number values;

for each pair plus clue, pair times clue, central plus clue, or central times clue added to the partial puzzle layout, attempt to solve the puzzle to determine if the puzzle has only one solution; and store a representation of at least the partial puzzle layout on the storage device.

7. The system of claim 6, the computing device further configured at least to:

while the puzzle has more than one possible solution, add one or more central plus clues or central times clues to one or more selected central clue regions of the partial puzzle layout, the one or more central plus clues or central times clues conforming to the set of hidden number values identify one or more pair plus clues or pair times clues associated with one or more pair clue regions and one or more central plus clues or central times clues associated with one or more central clue regions, each of the one or more pair plus clues or pair times clues associated with at least one pair of mystery number regions having a plurality of potential hidden values, the identifying based at least in part on attempting to solve the puzzle using a deterministic search of potential solutions;

select a first clue from the one or more pair plus clues or pair times clues based at least in part on the one or more pair plus clues or pair times clues being associated with a pair of mystery number regions having a least number of potential hidden values; and assign a pair of candidate hidden values to the pair of mystery number regions associated with the first clue.

8. The system of claim 7, the computing device further configured at least to:

choose between adding the pair plus clue, the pair time clues, the central plus clue and the central times clue based at least in part on which addition will lead to a larger reduction in a total number of complete solutions or partial solutions for the puzzle.

9. The system of claim 6, the computing device further configured at least to:

while the puzzle has more than one possible solution, add a central plus clue or a central times clue to a central clue region, the central plus clue or the central times clue based at least in part on one or more hidden values of the set of hidden values; and while the puzzle has more than one possible solution, add a selected central plus clue or selected central times clue to a selected central clue area, the central clue area selected based at least in part on a product of hidden values associated with mystery number regions in the selected central clue area.

10. The system of claim 6, the computing device further configured at least to:

while the puzzle has more than one possible solution, add a central times clues to a central clue region, the central times clue based at least in part on one or more hidden values of the set of hidden values and at least in part on the central clue region having a least hidden value for the central times clue.

11. The system of claim 6, wherein the one or more pair plus clues or pair times clues added to the puzzle layout are based at least in part on the hidden number values of the set of hidden number values corresponding to each pair of mystery number regions corresponding to the one or more pair plus clues or pair times clues having a least number of associated prime mystery number values.

12. The system of claim 6, wherein the puzzle layout is formed from a pattern comprised of the first areas and the second areas.

13. The system of claim 12, wherein the pattern is symmetrical.

14. The system of claim 12, wherein the pattern is asymmetrical.

15. The system of claim 12, wherein the pattern is configured for application to a two dimensional object.

16. The system of claim 12, wherein the pattern is configured for application to a three dimensional object.

17. The system of claim 12, wherein the pattern includes an empty area within the pattern including neither a first area nor a second area.

18. The system of claim 6, the computing device further configured at least to:

add the pair plus clue or the pair times clue to a selected pair clue region of the one or more selected pair clue regions based at least in part on the selected pair clue region having a least number of surrounding pair clue regions with the pair plus clues or the pair times clues already added.

19. The system of claim 6, the computing device further configured at least to:

add the pair plus clue or the pair times clue to a selected pair clue region of the one or more selected pair clue regions based at least in part on the selected pair clue region being farthest from existing pair clue regions with the pair plus clues or the pair times clues already added.

20. The system of claim 6, the computing device further configured at least to:

estimate a difficulty for the puzzle based at least in part on at least one of:

a count of the pair plus clues, the pair times clues, the central plus clues and the central times clues;

a count of mystery number regions associated with hidden number values of one;

a single central clue region with repeating mystery number values in the mystery number regions and a single central times clue having associated hidden number values of five, seven, eight, and nine;

a presence or absence of large hidden number values;

a count of central clue regions clues having a times-sixteen central times clue; or a count of the pair plus clues, the pair times clues, the central plus clues and central times clues having associated hidden number values from among at least two of the numbers three, four, or six.

21. The system of claim 20, the computing device further configured at least to:

add an additional pair plus clue or pair times clue to the puzzle when the estimated difficulty for the puzzle is more than a desired difficulty.

22. The system of claim 6, the computing device further configured at least to:

associate one or more joker or wildcard number values with the set of hidden number values.

23. A system for generating puzzles, the system comprising:

a computing device comprising one or more processors communicatively coupled to one or more memories and a storage device, the computing device configured at least to:

receive information indicative of a mathematical puzzle configuration;

generate a puzzle layout conforming to the information indicative of the puzzle configuration, the puzzle layout including first areas of the puzzle including a plurality of clue regions and second areas of the puzzle including a plurality of mystery number regions, wherein the first areas of the puzzle and the second areas of the puzzle are in separate locations, wherein the plurality of clue regions include either a pair clue region interposed between a pair of mystery number regions, a central clue region surrounded by three or more mystery number regions, or both the pair clue region and the central clue region, wherein each of the mystery number regions corresponds to a mystery number value with no limitation on an amount of times a single mystery number value between 1-R appears in the puzzle when the puzzle is solved except that a same pair of mystery number values corresponding to the pair of mystery number regions interposing any pair clue region can only appear once in the puzzle unless the pairs of mystery number regions interposing three or more pair clue regions also form the three or more mystery number regions surrounding a single central clue, in which case the same mystery number value is utilized for all mystery number regions among the pairs of mystery number regions, wherein R is a whole number within a range of whole number values, wherein the puzzle can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, wherein the central clue region corresponds to a central plus clue representing an arithmetic sum of mystery number values of the mystery number regions surrounding the central clue region or a central times clue representing an arithmetic product of mystery number values of the mystery number regions surrounding the central clue region, and wherein the puzzle layout is initially devoid of pair plus clues, pair times clues, central plus clues, central times clues, and mystery number values;

generate a set of hidden number values, each hidden number value associated with a mystery number region in the puzzle layout;

while the puzzle has more than one possible solution, add one or more central times clues to one or more selected central clue regions to create a partial puzzle layout, the one or more central times clues based at least in part on one or more hidden values of the set of hidden values, or add one or more pair plus clues to one or more pair clue regions to further create the partial puzzle layout, the one or more pair plus clues based at least in part on one or more hidden values of the set of hidden values, or add both one or more central times clues and one or more pair plus clues to create the partial puzzle layout;

for each pair plus clue added to the partial puzzle layout, or for each central times clue added to the partial puzzle layout, or for each pair plus clue and central times clue added to the partial puzzle layout, attempt to solve the puzzle to determine if the puzzle has only one solution; and store a representation of at least the partial puzzle layout on the storage device.

24. The system of claim 23 wherein the addition of the one or more central times clues or the one or more pair plus clues is based on which of the one or more central times clues and the one or more pair plus clues leads to a larger reduction in possible solutions for the puzzle.

25. The system of claim 23, the computer device is further configured to reveal the hidden number value associated with one or more mystery number regions prior to storing the representation of the partial puzzle layout on the storage device, wherein each revealed hidden number value decreases an amount of time required to solve the puzzle.

26. A non-transitory computer-readable storage medium having stored thereon information indicative of a puzzle, the information indicative of a puzzle generated by a method comprising:

receiving information indicative of a mathematical puzzle configuration;

generating a puzzle layout conforming to the information indicative of the puzzle configuration, the puzzle layout first areas of the puzzle including a plurality of clue regions and second areas of the puzzle including a plurality of mystery number regions, wherein the first areas of the puzzle and the second areas of the puzzle are in separate locations, wherein the plurality of clue regions include either a pair clue region interposed between a pair of mystery number regions, a central clue region surrounded by three or more mystery number regions, or both the pair clue region and the central clue region, wherein each of the mystery number regions corresponds to a mystery number value with no limitation on an amount of times a single mystery number value between 1-R appears in the puzzle when the puzzle is solved except that a same pair of mystery number values corresponding to the pair of mystery number regions interposing any pair clue region can only appear once in the puzzle unless the pairs of mystery number regions interposing three or more pair clue regions also form the three or more mystery number regions surrounding a single central clue, in which case the same mystery number value is utilized for all mystery number regions among the pairs of mystery number regions, wherein R is a whole number within a range of whole number values, wherein the puzzle can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, wherein the central clue region corresponds to a central plus clue representing an arithmetic sum of mystery number values of the mystery number regions surrounding the central clue region or a central times clue representing an arithmetic product of mystery number values of the mystery number regions surrounding the central clue region, and wherein the puzzle layout is initially devoid of pair plus clues, pair times clues, central plus clues, central times clues, and mystery number values;

associating a mystery number value with each mystery number region in the puzzle layout;

adding, while the puzzle has more than one possible solution, one or more pair plus clues or pair times clues to one or more selected pair clue regions to create the puzzle layout, the one or more pair plus clues or pair times clues conforming to the mystery number values associated with the mystery number regions in the puzzle layout;

for each pair plus clue or pair times clues added to the puzzle layout, attempting to solve the puzzle to determine if the puzzle layout has only one solution;

repeating adding and attempting to solve the puzzle until the puzzle layout has only one solution; and storing a representation of the puzzle layout having only one solution on the non-transitory computer-readable storage medium.

27. The non-transitory computer-readable storage medium of claim 26, wherein the method further comprises:

adding, while the puzzle has more than one possible solution, one or more central plus clues or central times clues to one or more selected central clue regions to create the puzzle layout, the one or more central plus clues or central times clues conforming to the mystery number values associated with the mystery number regions in the puzzle layout; and choosing between adding central plus clue or the central times clue based at least in part on which central plus clue or central times clue will lead to a larger reduction in a total number of complete solutions or partial solutions.

28. The non-transitory computer-readable storage medium of claim 26, wherein the method further comprises:

adding the pair plus clue or the pair times clue to the one or more selected pair clue regions is based at least in part on the pair plus clue region being farthest from pair plus clues or pair times clues already added to pair clue regions.

29. A non-transitory computer-readable storage medium having stored thereon instructions that, upon execution by a computing device, cause the computing device at least to:

receive information indicative of a mathematical puzzle configuration for generating a puzzle layout, the puzzle layout including first areas of the puzzle including a plurality of clue regions and second areas of the puzzle including a plurality of mystery number regions, wherein the first areas of the puzzle and the second areas of the puzzle are in separate locations, wherein the plurality of clue regions include either a pair clue region interposed between a pair of mystery number regions, a central clue region surrounded by three or more mystery number regions, or both the pair clue region and the central clue region, wherein each of the mystery number regions corresponds to a mystery number value with no limitation on an amount of times a single mystery number value between 1-R appears in the puzzle when the puzzle is solved except that a same pair of mystery number values corresponding to the pair of mystery number regions interposing any pair clue region can only appear once in the puzzle unless the pairs of mystery number regions interposing three or more pair clue regions also form the three or more mystery number regions surrounding a single central clue, in which case the same mystery number value is utilized for all mystery number regions among the pairs of mystery number regions, wherein R is a whole number within a range of whole number values, wherein the puzzle can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, wherein the central clue region corresponds to a central plus clue representing an arithmetic sum of mystery number values of the mystery number regions surrounding the central clue region or a central times clue representing an arithmetic product of mystery number values of the mystery number regions surrounding the central clue region, and wherein the puzzle layout is initially devoid of pair plus clues, pair times clues, central plus clues, central times clues, and mystery number values, the information indicative of a puzzle configuration comprising information indicative of a desired number of pair plus clues or pair times clues;

generate the puzzle layout conforming to the information indicative of the puzzle configuration;

perform a set of operations that cause the computing device at least to add a plurality of pair plus clues or pair times clues to the puzzle layout, wherein a number of pair plus clues or pair times clues added is based at least in part on the information indicative of a desired number of pair plus clues or pair times clues;

attempt to solve the puzzle to determine if the puzzle only has one solution; and perform the set of operations again upon determining that there is more than one possible solution for the puzzle layout until the puzzle layout has only one solution.

30. A non-transitory computer-readable storage medium having stored thereon instructions that, upon executing by a computing device, cause the computing device to:

generate a graphical user interface on a display of the computing device, the graphical user interface comprising a mathematical puzzle layout including first areas of the puzzle layout having a plurality of clue regions and second areas of the puzzle layout having a plurality of mystery number regions, wherein the first areas of the puzzle layout and the second areas of the puzzle layout are in separate locations, wherein the plurality of clue regions include a pair clue region interposed between a pair of mystery number regions, wherein each of the mystery number regions corresponds to a mystery number value with no limitation on an amount of times a single mystery number value between 1-R appears in the puzzle layout when the puzzle layout is solved except that a same pair of mystery number values corresponding to the pair of mystery number regions interposing any pair clue region can only appear once in the puzzle layout, wherein R is a whole number within a range of whole number values, wherein the puzzle layout can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, and wherein the puzzle layout is initially devoid of pair plus clues, pair times clues, and mystery number values, receive missing mystery number values from a user via the graphical user interface based on the pair plus clues or the pair times clues.

31. The non-transitory computer-readable storage medium of claim 30, wherein the puzzle layout further includes at least one central clue region surrounded by at least three or more mystery number regions, wherein the same pair of mystery number values corresponding to the pair of mystery number regions interposing any pair clue region can appear more than once in the puzzle layout if the pairs of mystery number regions interposing three or more pair clue regions also form the three or more mystery number regions surrounding a single central clue, in which case the same mystery number value is utilized for all mystery number regions among the pairs of mystery number regions, wherein the central clue region corresponds to a central plus clue representing an arithmetic sum of mystery number values of the mystery number regions surrounding the central clue region or a central times clue representing an arithmetic product of mystery number values of the mystery number regions surrounding the central clue region, wherein the puzzle layout is also initially devoid of pair times clues and central plus clues, wherein the graphical user interface further receives missing mystery number values based on the central plus clues and the central times clues, and wherein one or more of the pair plus clues, pair times clues, central plus clues or central times clues contain one or more prepopulated clues.

32. The non-transitory computer-readable storage medium of claim 31, wherein a prepopulated pair clue is based on a central clue region that has a shared mystery number region with the pair clue region.

33. The non-transitory computer-readable storage medium of claim 31, wherein one or more central clue regions contain one or more prepopulated central times clues or central plus clues and wherein one or more pair clue regions contain one or more prepopulated pair plus clues or pair times clues.

34. The non-transitory computer-readable storage medium of claim 31, wherein a central clue region is surrounded by four mystery number regions and each of the four mystery number regions interpose a pair clue region surrounding the central clue region to form a geometric pattern.

35. The non-transitory computer-readable storage medium of claim 30, wherein the puzzle layout further includes the first areas and the second areas combined together to form one or more geometric patterns.

36. The non-transitory computer-readable storage medium of claim 35, wherein one or more mystery number values among the plurality of mystery number regions may be prepopulated.

37. The non-transitory computer-readable storage medium of claim 35, wherein the one or more geometric patterns are displayed on the display of a computing device.

38. The non-transitory computer-readable storage medium of claim 35, wherein the one or more geometric patterns are wrapped in whole or in part around a three-dimensional graphic object.

39. The non-transitory computer-readable storage medium of claim 38, wherein one or more areas within the one or more geometric patterns where one or more of the plurality of central clue regions could be located are blank and form a hole in the three-dimensional graphic object.

40. The non-transitory computer-readable storage medium of claim 35, wherein one or more areas within the one or more geometric patterns where one or more of the plurality of central clue regions could be located are blank and do not include a central clue region.

41. The non-transitory computer-readable storage medium of claim 30, wherein a plurality of sets of pairs of mystery number regions interposing pair clues are combined together to form one or more different geometric patterns.

42. The non-transitory computer-readable storage medium of claim 41, wherein the puzzle layout is filled in by receiving any missing mystery number value among the plurality of sets.

43. The non-transitory computer-readable storage medium of claim 42, wherein one or more mystery number values may be prepopulated as a clue toward completely filling in the puzzle layout with mystery number values in each of the mystery number regions.

44. The non-transitory computer-readable storage medium of claim 41, wherein the one or more geometric patterns are displayed on the display of a computing device.

45. The non-transitory computer-readable storage medium of claim 41, wherein the one or more geometric patterns are wrapped in whole or in part around a three-dimensional graphic object.

46. A non-transitory computer readable storage medium comprising instructions that, when executed on a system, cause the system to at least:

cause generation of a graphical user interface operative to display an interactive mathematical puzzle having only one solution, the interactive puzzle including first areas of the puzzle having a plurality of clue regions and second areas of the puzzle having a plurality of mystery number regions, wherein the first areas of the puzzle and the second areas of the puzzle are in separate locations, wherein the plurality of clue regions include a pair clue region interposed between a pair of mystery number regions, wherein each of the mystery number regions corresponds to a mystery number value with no limitation on an amount of times a single mystery number value between 1-R appears in the puzzle when the puzzle is solved except that a same pair of mystery number values corresponding to the pair of mystery number regions interposing any pair clue region can only appear once in the puzzle, wherein R is a whole number within a range of whole number values, wherein the puzzle can only have one solution when each mystery number value associated with each mystery number region among the plurality of mystery numbers regions are solved, wherein the pair clue region corresponds to a pair plus clue representing an arithmetic sum of mystery number values of the mystery number regions interposing the pair clue region or a pair times clue representing an arithmetic product of mystery number values of the mystery number regions interposing the pair clue region, and wherein the puzzle layout is initially devoid of pair plus clues, pair times clues, and mystery number values;

reveal at least one pair plus clue or one pair times clue within at least one pair clue region among the plurality of pair clue regions;

enable a user to enter an integer value in place of each mystery number region through a number entry system; and indicate to the user whether the integer value entered by the user in each of the mystery number regions is correct.

47. The non-transitory computer readable storage medium as recited in claim 46, wherein the graphical user interface is operative to operate in a first mode where the indication of whether an integer value entered by the user is correct is immediate, and a second mode where the indication of whether the integer values entered by the user is correct is not provided until all of the mystery number regions have had integer values entered as a complete solution to the puzzle and the user has submitted the complete solution through the graphical user interface.

48. The non-transitory computer readable storage medium as recited in claim 46, wherein the graphical user interface is operative to display one or more interactive puzzles at one or more levels, the one or more levels being based on a puzzle complexity based at least on a layout of the interactive puzzle.

49. The non-transitory computer readable storage medium as recited in claim 48, wherein the one or more interactive puzzles are premade and stored in the non-transitory computer readable storage medium.

50. The non-transitory computer readable storage medium as recited in claim 48, wherein the one or more interactive puzzles are generated in real-time.

51. The non-transitory computer readable storage medium as recited in claim 48, wherein the one or more interactive puzzles are retrieved from a remote system.

52. The non-transitory computer readable storage medium as recited in claim 46, wherein the graphical user interface is operative to provide the user with a score as the user attempts to solve the interactive puzzle.

53. The non-transitory computer readable storage medium as recited in claim 46, wherein the graphical user interface is operative to provide the user with one or more hints including one or more pair plus clues or pair times clues for one or more of the pair clue regions.

54. The non-transitory computer readable storage medium, as recited in claim 53, wherein the one more hints are associated with the number entry system.

55. The non-transitory computer readable storage medium as recited in claim 46, wherein the graphical user interface is operative to display the number entry system including each of the integer values and one or more notes for enabling the user to guess at possible integer values for the plurality of mystery number regions or to guess at possible pair plus clues or pair times clues for the plurality of pair clue regions.

56. The non-transitory computer readable storage medium as recited in claim 55, wherein the one or more notes are coded differently for each mystery number region among the plurality of mystery number regions and each pair plus clue and pair times clue among the plurality of pair clue regions.

57. The non-transitory computer readable storage medium as recited in claim 46, wherein the interactive puzzle includes a plurality of central clue regions, wherein each central clue region is surrounded by three or more mystery number regions, wherein the same pair of mystery number values corresponding to the pair of mystery number regions interposing any pair clue region can appear more than once in the puzzle if the pairs of mystery number regions interposing three or more pair clue regions also form the three or more mystery number regions surrounding a single central clue, in which case the same mystery number value is utilized for all mystery number regions among the pairs of mystery number regions, wherein the central clue region corresponds to a central plus clue representing an arithmetic sum of mystery number values of the mystery number regions surrounding the central clue region or a central times clue representing an arithmetic product of mystery number values of the mystery number regions surrounding the central clue region, wherein the puzzle layout is also initially devoid of central times clues and central plus clues, and wherein the instructions cause the system to at least reveal at least one central plus clue or central times clue within at least one central clue region among the plurality of central clue regions.

58. The non-transitory computer readable storage medium as recited in claim 57, wherein the graphical user interface is operative to provide the user with one or more hints including one or more central plus clues or one or more central times clues for the plurality of central clue regions.

* * * * *